US010842245B2

(12) United States Patent
Revels

(10) Patent No.: US 10,842,245 B2
(45) Date of Patent: Nov. 24, 2020

(54) BACKPACK SYSTEM WITH WATERPROOF BAG

(71) Applicant: Watershed, LLC, Asheville, NC (US)

(72) Inventor: Eric Revels, New Orleans, LA (US)

(73) Assignee: WATERSHED, LLC, Asheville, NC (US)

( * ) Notice: Subject to any disclaimer, the term of this patent is extended or adjusted under 35 U.S.C. 154(b) by 65 days.

(21) Appl. No.: 16/209,806

(22) Filed: Dec. 4, 2018

(65) Prior Publication Data

US 2019/0166981 A1 Jun. 6, 2019

Related U.S. Application Data

(60) Provisional application No. 62/594,306, filed on Dec. 4, 2017.

(51) Int. Cl.

| | |
|---|---|
| ***A45F 3/08*** | (2006.01) |
| ***A45F 3/10*** | (2006.01) |
| ***A45F 3/04*** | (2006.01) |

(52) U.S. Cl.

CPC ..... *A45F 3/08* (2013.01); *A45F 3/04* (2013.01); *A45F 3/10* (2013.01); *A45F 2003/045* (2013.01)

(58) Field of Classification Search

CPC ..... A45F 3/08; A45F 3/04; A45F 3/10; A45F 2003/045

USPC ..... 224/191

See application file for complete search history.

(56) References Cited

U.S. PATENT DOCUMENTS

| | | | | |
|---|---|---|---|---|
| 1,467,268 | A * | 9/1923 | Deiss | A47G 25/54 383/91 |
| 5,579,966 | A * | 12/1996 | Krumweide | A45F 3/08 224/259 |
| 5,803,332 | A * | 9/1998 | Thompson | A45F 3/04 224/153 |
| 5,918,785 | A * | 7/1999 | Irose | A45F 3/14 224/250 |
| 5,987,779 | A * | 11/1999 | Litchfield | A43B 13/203 36/29 |
| 6,135,334 | A * | 10/2000 | Seichter | A45F 3/04 224/250 |
| 6,216,926 | B1 * | 4/2001 | Pratt | A45F 3/04 224/148.2 |
| 6,347,730 | B1 * | 2/2002 | Frederick | A45F 3/14 224/250 |

(Continued)

OTHER PUBLICATIONS

"How to attach an ALICE pack to an ALICE frame," Youtube Website, Available Online at https://www.youtube.com/watch?v=MwKF0p0RvTo, Uploaded Mar. 11, 2009, 5 pages.

(Continued)

*Primary Examiner* — Nathan J Newhouse
*Assistant Examiner* — Lester L Vanterpool
(74) *Attorney, Agent, or Firm* — McCoy Russell LLP

(57) ABSTRACT

Methods and systems are provided for a backpack system including a frame-less waterproof bag and a backpack frame. In one example, a frame-less waterproof bag may include a frame-cap welded to an outer surface of the frame-less waterproof bag. The frame-cap may be adapted to couple the frame-less waterproof bag with the backpack frame while maintaining a waterproof quality of the frame-less waterproof bag.

6 Claims, 16 Drawing Sheets

(56) References Cited

U.S. PATENT DOCUMENTS

| | | | | |
|---|---|---|---|---|
| 6,626,342 | B1 * | 9/2003 | Gleason | A45F 3/08 224/633 |
| 7,971,764 | B2 * | 7/2011 | Sabbah | A45F 3/04 224/650 |
| 8,118,201 | B1 * | 2/2012 | Calkin | A45F 3/08 224/156 |
| 8,348,114 | B2 * | 1/2013 | Gleason, Jr. | A45F 3/08 224/633 |
| 8,381,956 | B2 * | 2/2013 | Gleason, Jr. | A45F 3/10 224/645 |
| 8,453,896 | B1 * | 6/2013 | Mansell | A45F 3/04 224/576 |
| 8,561,866 | B2 * | 10/2013 | Gleason, Jr. | A45F 3/047 224/631 |
| D699,941 | S * | 2/2014 | Robert | D3/216 |
| 9,119,460 | B2 * | 9/2015 | Ables | A45F 3/047 |
| 9,609,938 | B1 * | 4/2017 | Wilson | A45C 13/008 |
| 10,506,867 | B2 * | 12/2019 | Bowerman | A45F 3/04 |
| 2004/0099704 | A1 * | 5/2004 | Zion | A45F 3/08 224/576 |
| 2004/0108345 | A1 * | 6/2004 | Oh | A45C 9/00 224/153 |
| 2006/0273127 | A1 * | 12/2006 | Simms | A45C 13/002 224/576 |
| 2010/0032464 | A1 * | 2/2010 | Gleason, Jr. | A45F 3/08 224/631 |
| 2011/0278339 | A1 * | 11/2011 | Hexels | F41H 1/02 224/676 |
| 2013/0062387 | A1 * | 3/2013 | Gleason, Jr. | A45F 3/12 224/633 |

OTHER PUBLICATIONS

"Naval Special Warfare Group 3," Wikipedia Website, Available Online at https://en.wikipedia.org/wiki/Naval_Special_Warfare_Group_3, Website Available as Early as Jul. 26, 2009, 2 pages.

"Drypack 70", Arc'teryx Website, Available Online at https://leaf.arcteryx.com/us/en/shop/drypack-70, Available as Early as Jan. 2013, 3 pages.

"Mystery Ranch—NICE Frame," Youtube Website, Availalble Online at https://www.youtube.com/watch?v=z4i67hL-PT4, Uploaded Sep. 23, 2014, 3 pages.

"Warrior East—Watershed Drybags Patrol Carrier," Soldier Systems Website, Available Online at http://soldiersystems.net/2016/07/14/warrior-east-watershed-drybags-patrol-carrier/, Jul. 14, 2016, 2 pages.

"Kodiak Pack", Watershed Dry Bags Website, Available Online at https://www.drybags.com/product/kodiak-pack/, Retrieved on Nov. 30, 2018, 4 pages.

"Large Ruck Liner, ZipDry®", Watershed Dry Bags Website, Available Online at https://www.drybags.com/product/large-ruck-liner-zipdry/, Retrieved on Nov. 30, 2018, 4 pages.

* cited by examiner

BACKPACK SYSTEM WITH WATERPROOF BAG

CROSS REFERENCE TO RELATED APPLICATIONS

The present application claims priority to U.S. Provisional Application No. 62/594,306, entitled "BACKPACK SYSTEM WITH WATERPROOF BAG", and filed on Dec. 4, 2017. The entire contents of the above-listed application are hereby incorporated by reference for all purposes.

FIELD

The present description relates generally to methods and systems for a backpack system including a frame-less waterproof bag having a mounted frame-cap.

BACKGROUND AND SUMMARY

Backpack systems often include containers, such as bags, configured to attach to a wearer and shaped to store one or more items to be transported by the wearer. A weight of the bags is often supported by the wearer via a plurality of straps, cables, and the like. Rugged bags for backpack systems often include a rigid, integrated frame configured to increase a load-carrying quality of the backpack systems. The rigid frame is often integrated with the bag via one or more layers of fabric stitched to both of the frame and the bag, resulting in a bag and frame that are non-removably coupled to each other.

However, the inventors herein have recognized potential issues with such systems. As one example, integrating a frame and bag of a backpack system together as a single unit may reduce a packable quality and adjustability of the backpack system. Further, coupling the bag and frame together via stitching results in a plurality of holes or perforations in a fabric of the bag at the locations of the stitching, reducing a water resistance of the bag. During conditions in which the backpack system is submersed in water or utilized in rainy weather, water may flow through the stitching and into an interior of the bag and waterlog the contents of the bag.

In one example, the issues described above may be addressed by a frame-less waterproof bag, comprising: an outer surface of the waterproof bag; and a frame-cap having a plurality of edges coupled to the outer surface without any penetration through the outer surface to maintain waterproof integrity of the outer surface, the frame-cap including a pocket releasably coupleable to a backpack frame. In this way, the frame-cap enables the frame-less waterproof bag to couple to the backpack frame without reducing a waterproof quality of the bag.

As one example, the frame-cap may be radio frequency (RF) welded to the outer surface of the frame-less waterproof bag. The RF welded frame-cap provides a waterproof seal between the frame-cap and the outer surface without stitching, and enables the bag to be quickly coupled and/or decoupled from the backpack frame. In this way, the backpack frame increases a load-carrying quality of the frame-less waterproof bag without reducing the waterproof quality of the bag.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-15B are shown to scale, though other relative dimensions may be used, if desired.

DETAILED DESCRIPTION

Figure 6:
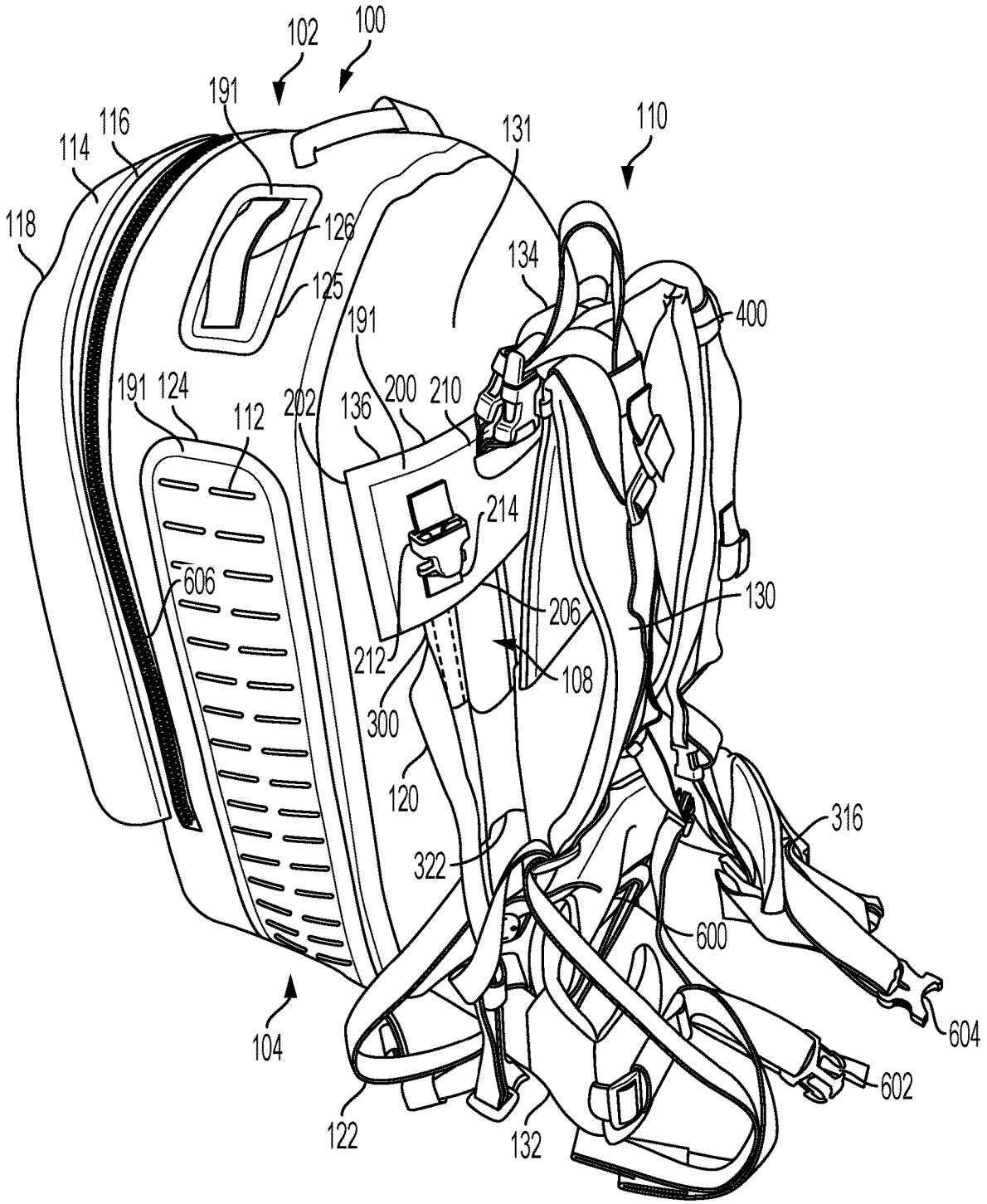
FIG. 6 shows a side perspective view of the backpack system, with a fastener cover of the frame-less waterproof bag in an opened position.
Figure 7:
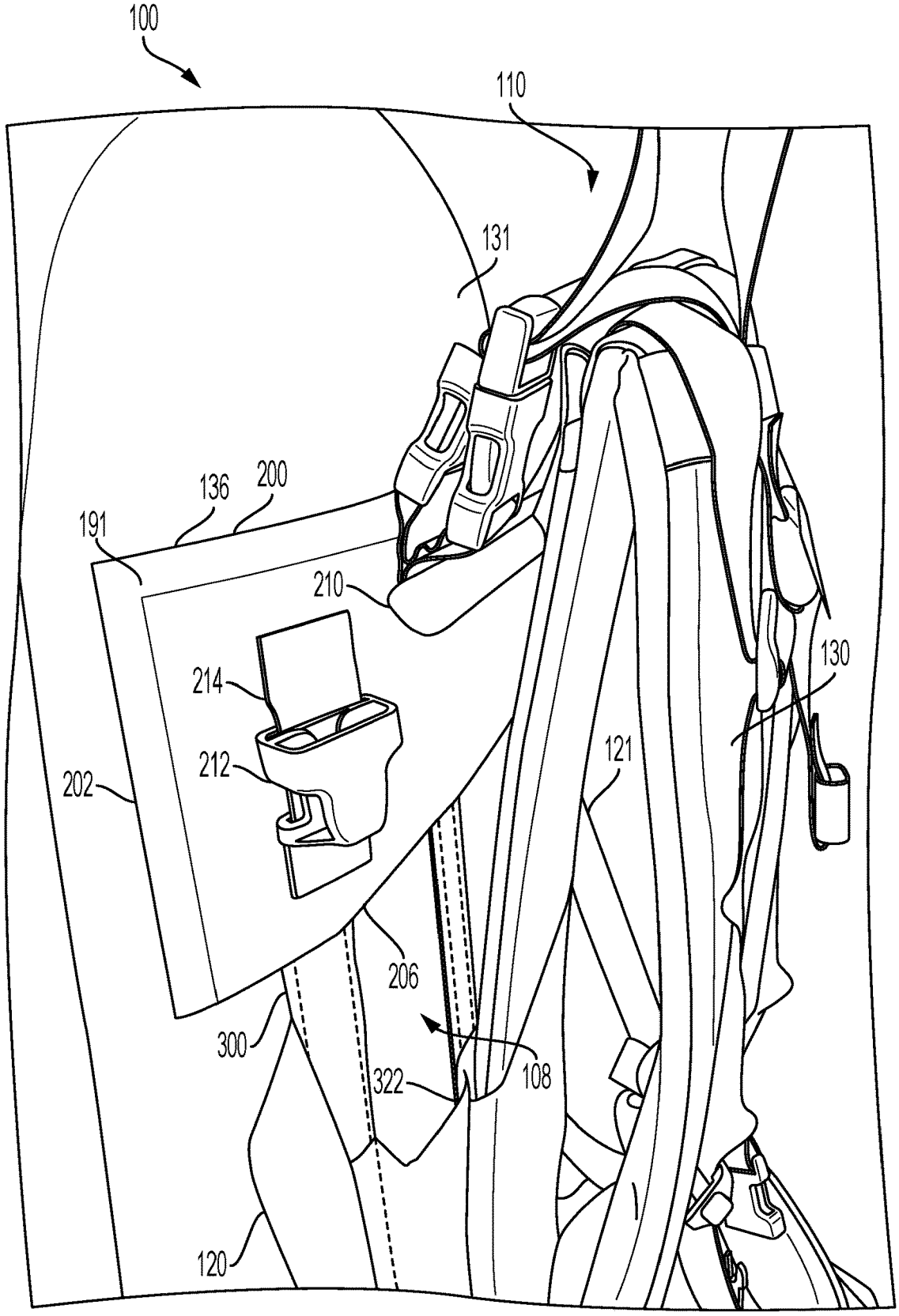
FIG. 7 shows an enlarged view of the backpack system, with the frame-cap of the frame-less waterproof bag coupled to the backpack frame.
Figure 8:
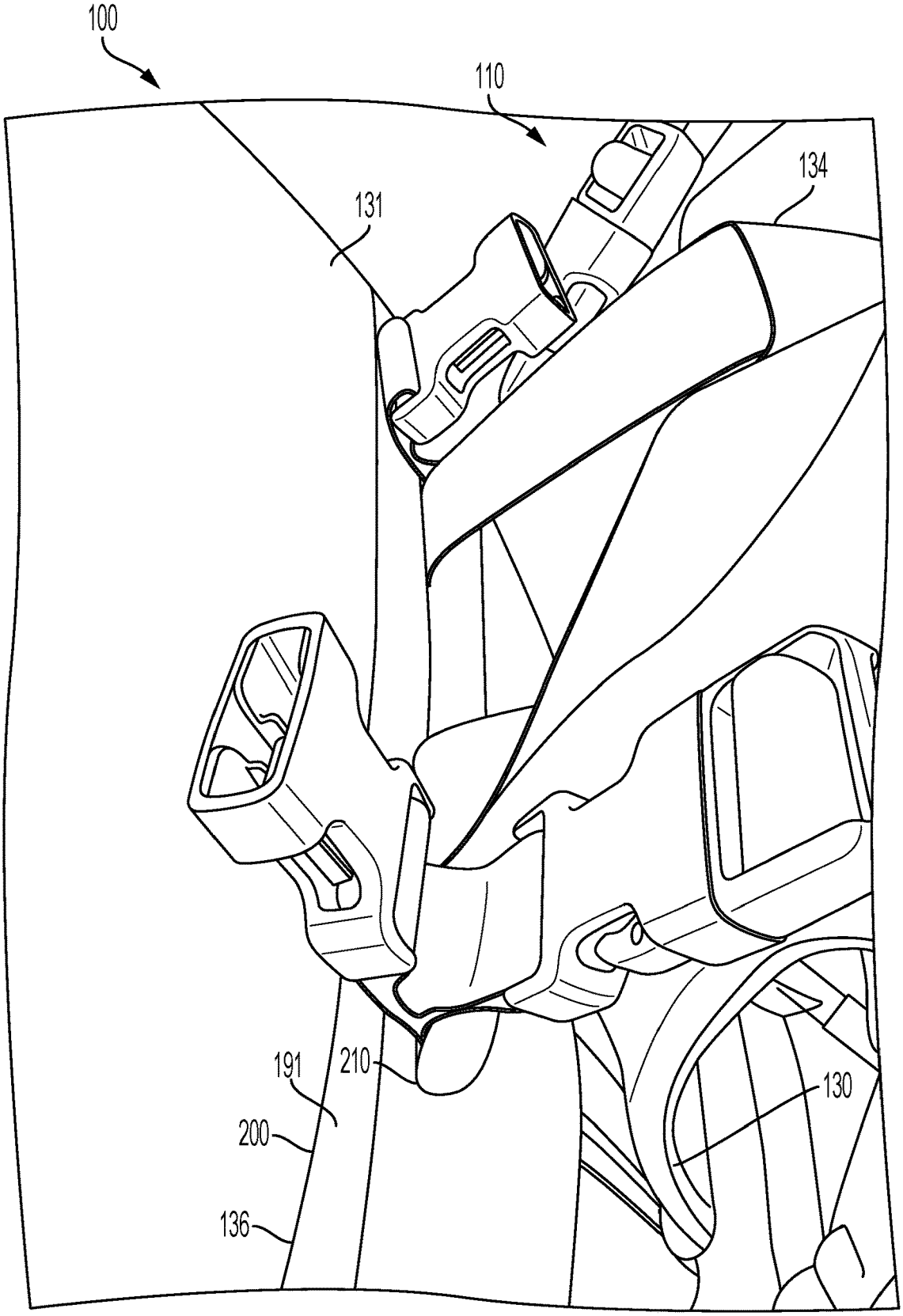
FIG. 8 shows an enlarged view of the backpack system, with a handle of the backpack frame inserted through a slot of the frame-cap of the frame-less waterproof bag.
Figure 9:
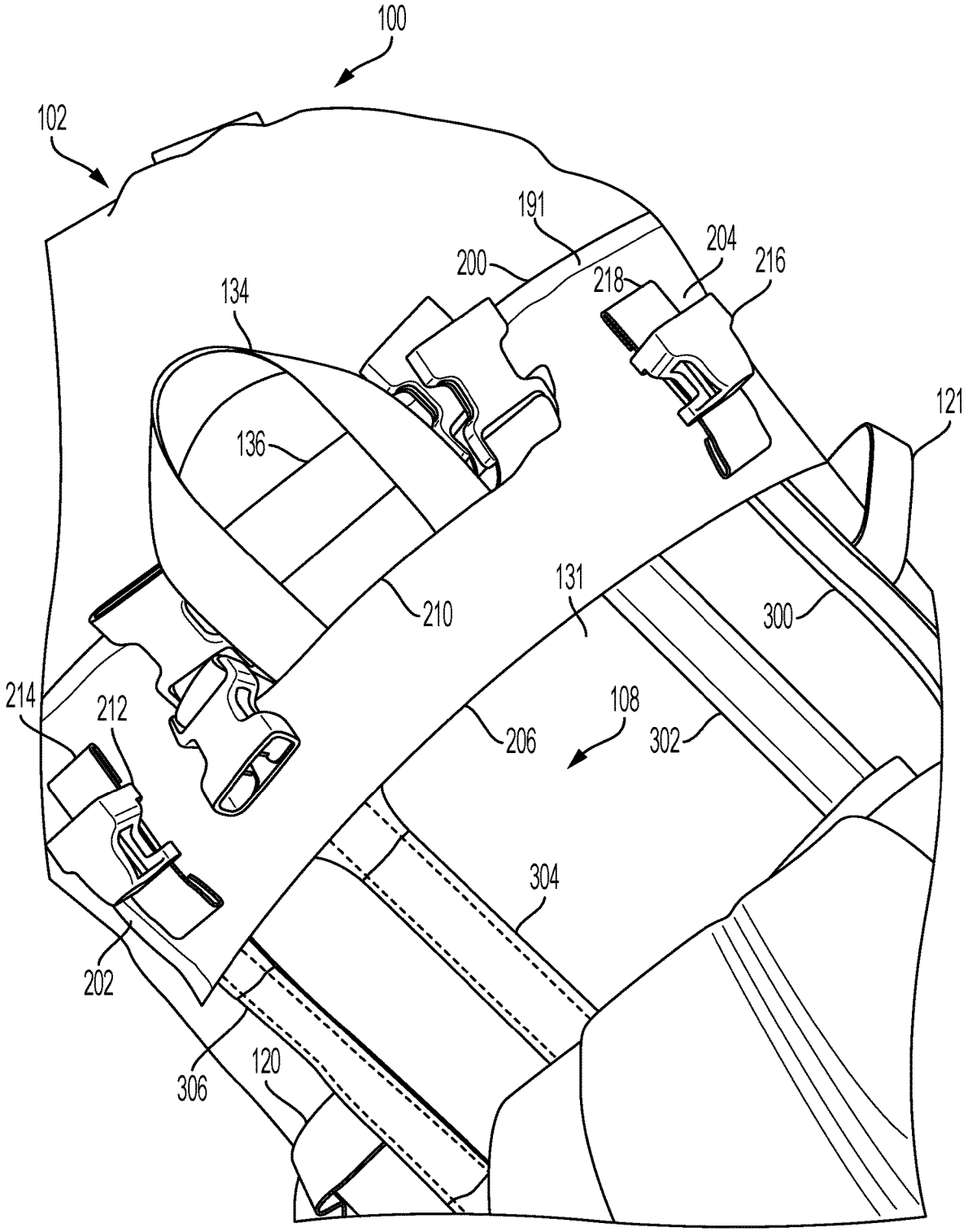
FIG. 9 shows a view of the first end of the frame-less waterproof bag of the backpack system, with the frame-cap of the frame-less waterproof bag coupled to the backpack frame.
Figure 10:
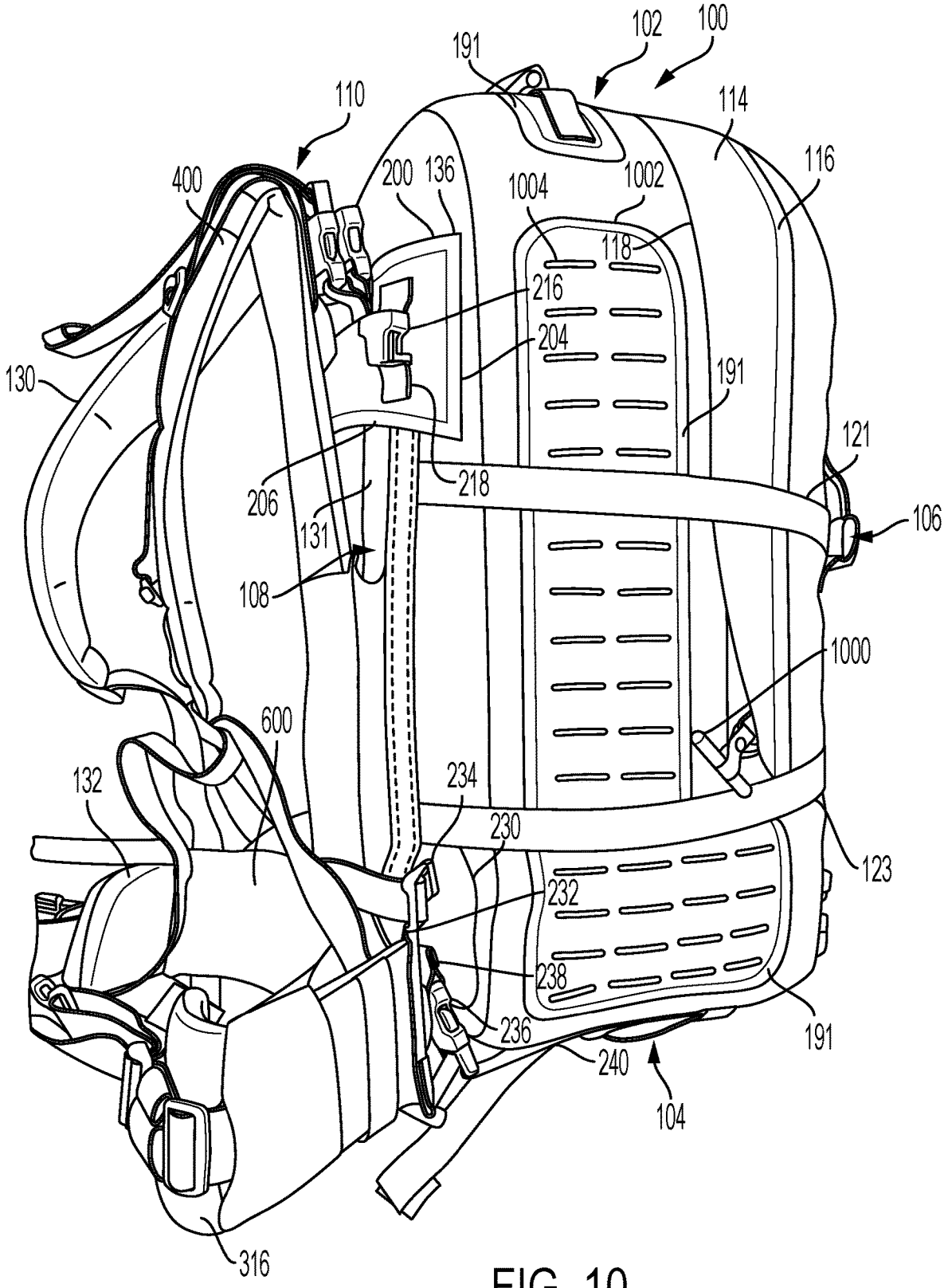
FIG. 10 shows a side view of the backpack system, with the frame-less waterproof bag coupled to the backpack frame.
Figure 11:
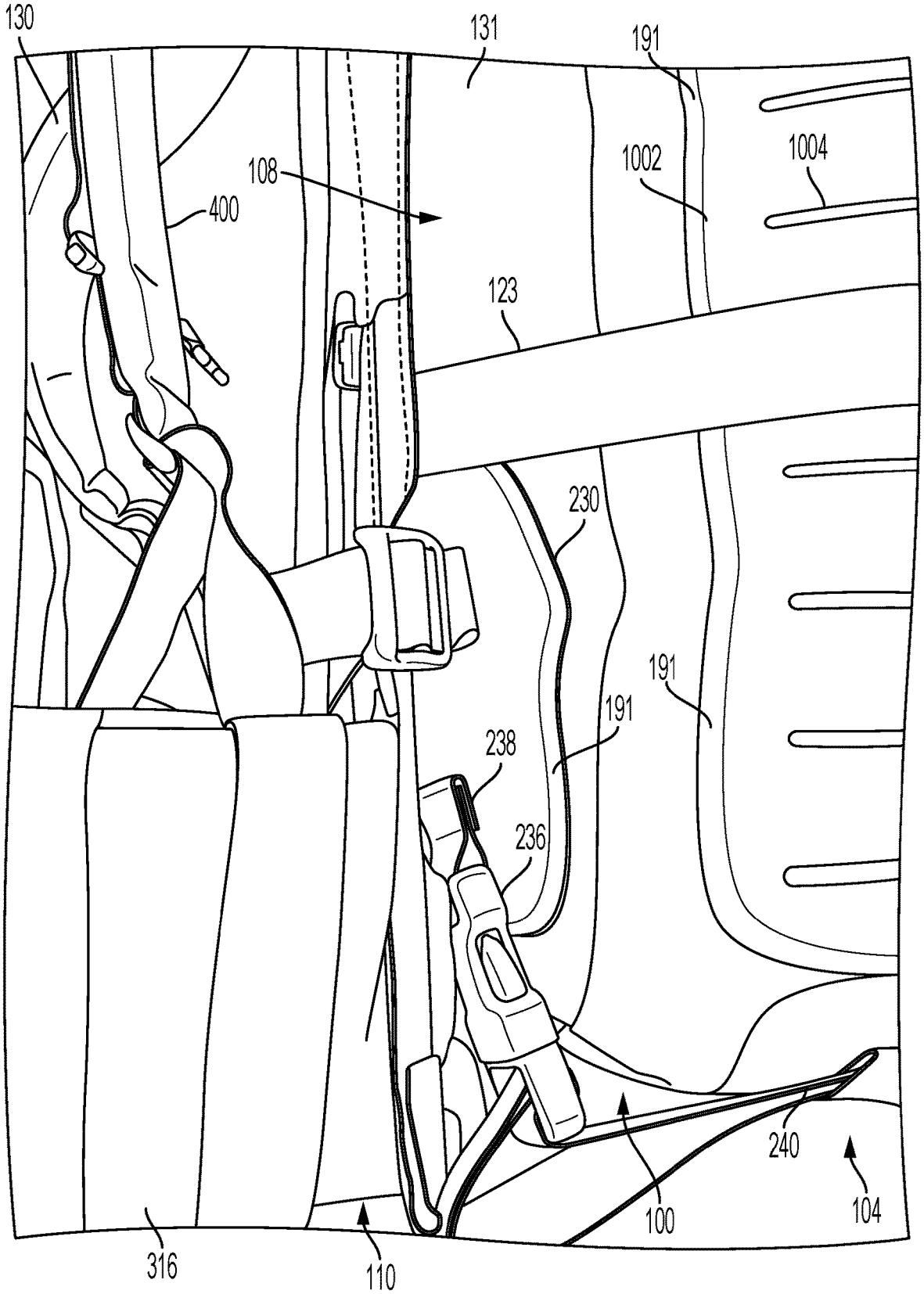
FIG. 11 shows an enlarged view of fastener module mounted at the first end of the frame-less waterproof bag.
Figure 12:
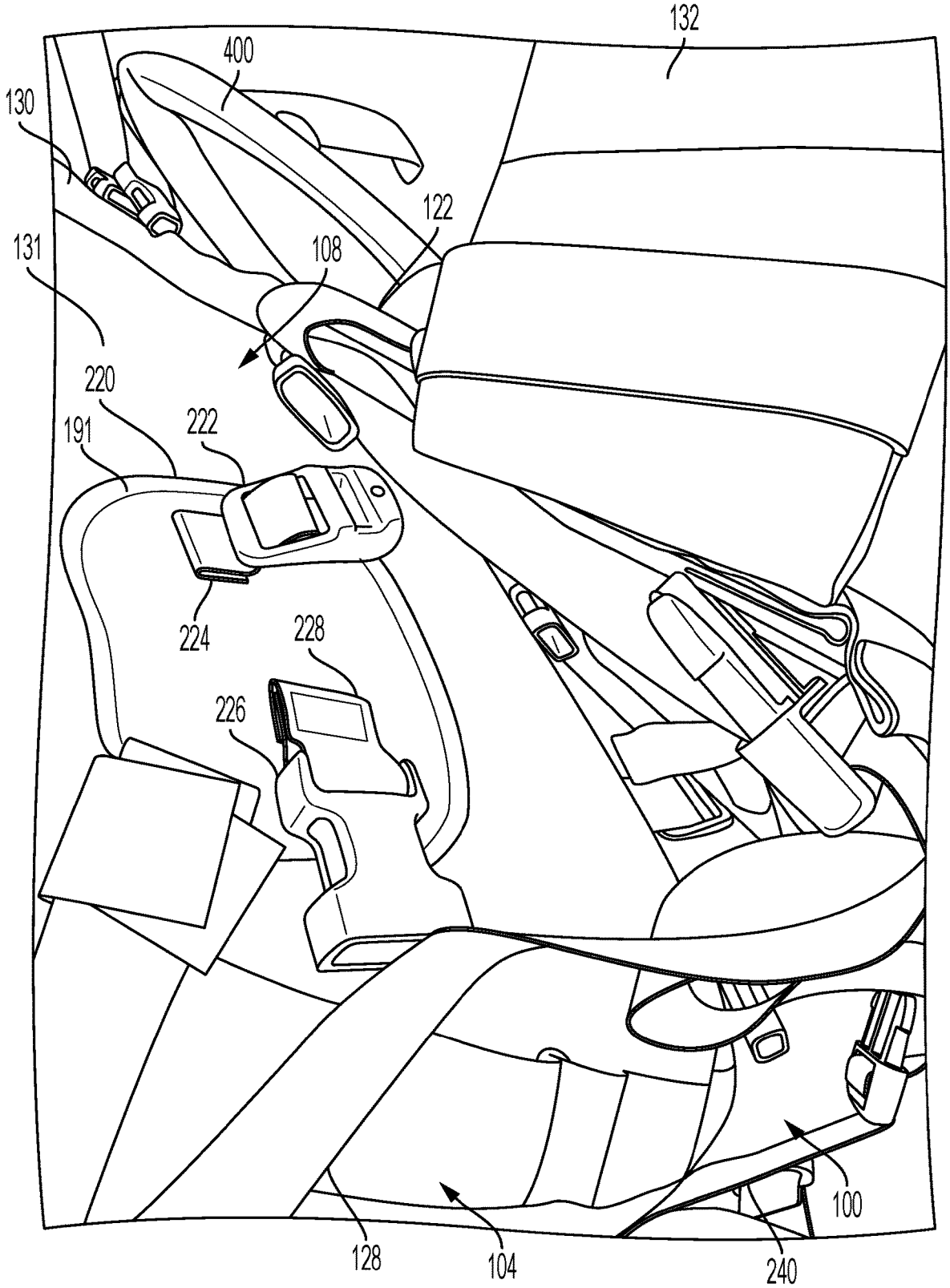
FIG. 12 shows an enlarged view of a second fastener module mounted at the first end of the frame-less waterproof bag.
Figure 13A:
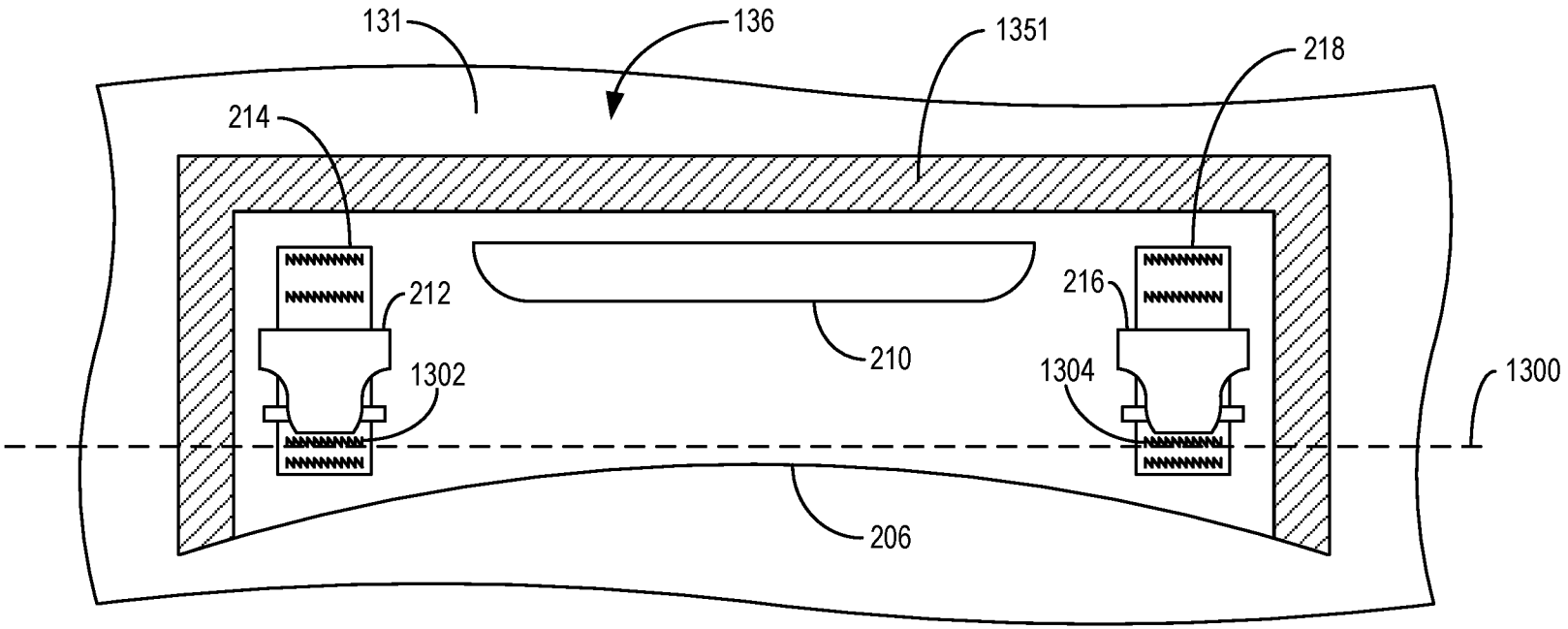
FIGS. 13A-15B show the frame-cap positioned against an outer surface of the frame-less waterproof bag during various stages of manufacturing the frame-less waterproof bag.
Figure 13B:
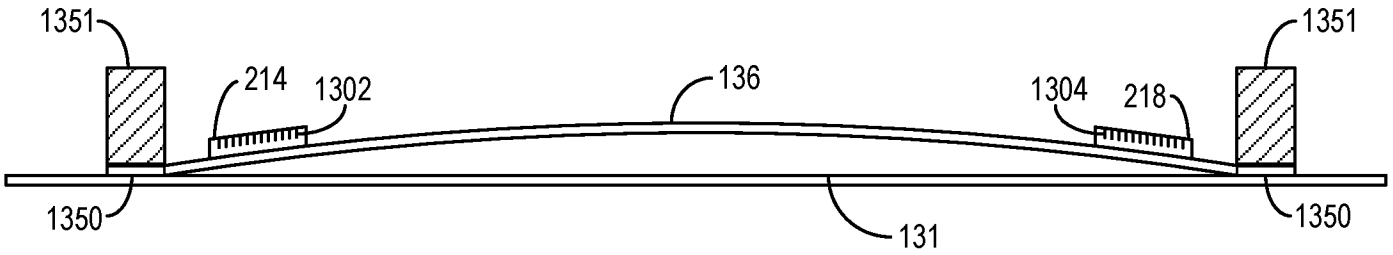
Figure 14:
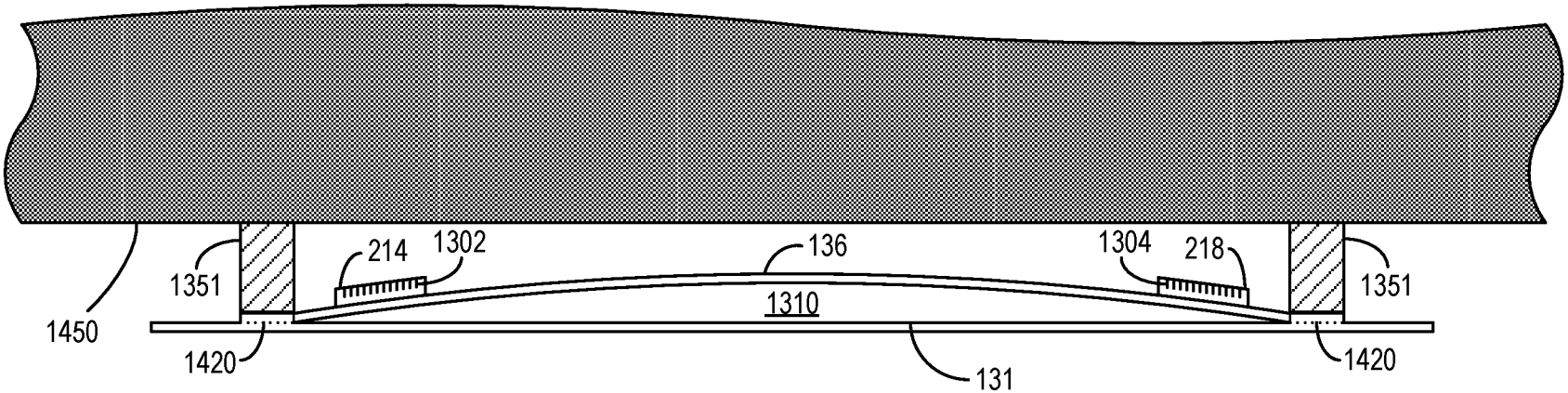

The following description relates to systems and methods for a backpack system including a frame-less waterproof bag having a mounted frame-cap. A backpack system, such as the backpack system shown by FIG. 1, includes a frame-less waterproof bag and a backpack frame. A frame-cap of the frame-less waterproof bag, as shown by FIG. 2, FIG. 7, and FIG. 9, is shaped to removably couple with the backpack frame such that positioning the frame-cap over the backpack frame couples the frame-less waterproof bag to the backpack frame. The frame-cap may include a slot shaped to receive a handle of the backpack frame, as shown by FIG. 8. The backpack frame and frame-less waterproof bag may additionally include a plurality of straps and bands configured to further couple the backpack frame and frame-less waterproof bag to each other, as shown by FIGS. 2-5 and FIG. 10. A main opening of the frame-less waterproof bag may be sealed by a fastener, such as a waterproof zipper, and covered by a moveable flap, as shown by FIG. 6. In some examples, the frame-less waterproof bag may include one or more patches mounted to exterior surfaces of the frame-less waterproof bag, as shown by FIGS. 11-12, in order to couple fasteners such as buckles to the frame-less waterproof bag without reducing the waterproof quality of the frame-less waterproof bag. The frame-cap may be a separate piece positioned against an outer surface of the frame-less waterproof bag, as shown by FIGS. 13A-13B, and welded to the outer surface, as shown by FIGS. 14-15B. The frame-cap may be radio frequency (RF) welded to the outer surface of the frame-less waterproof bag, as illustrated in the method shown by FIG. 16. In this way, the frame-less waterproof bag may be utilized by a wearer in a variety of conditions, such as submersed in water or in rainy weather, without water flowing into an interior of the frame-less waterproof bag.

Figure 1:
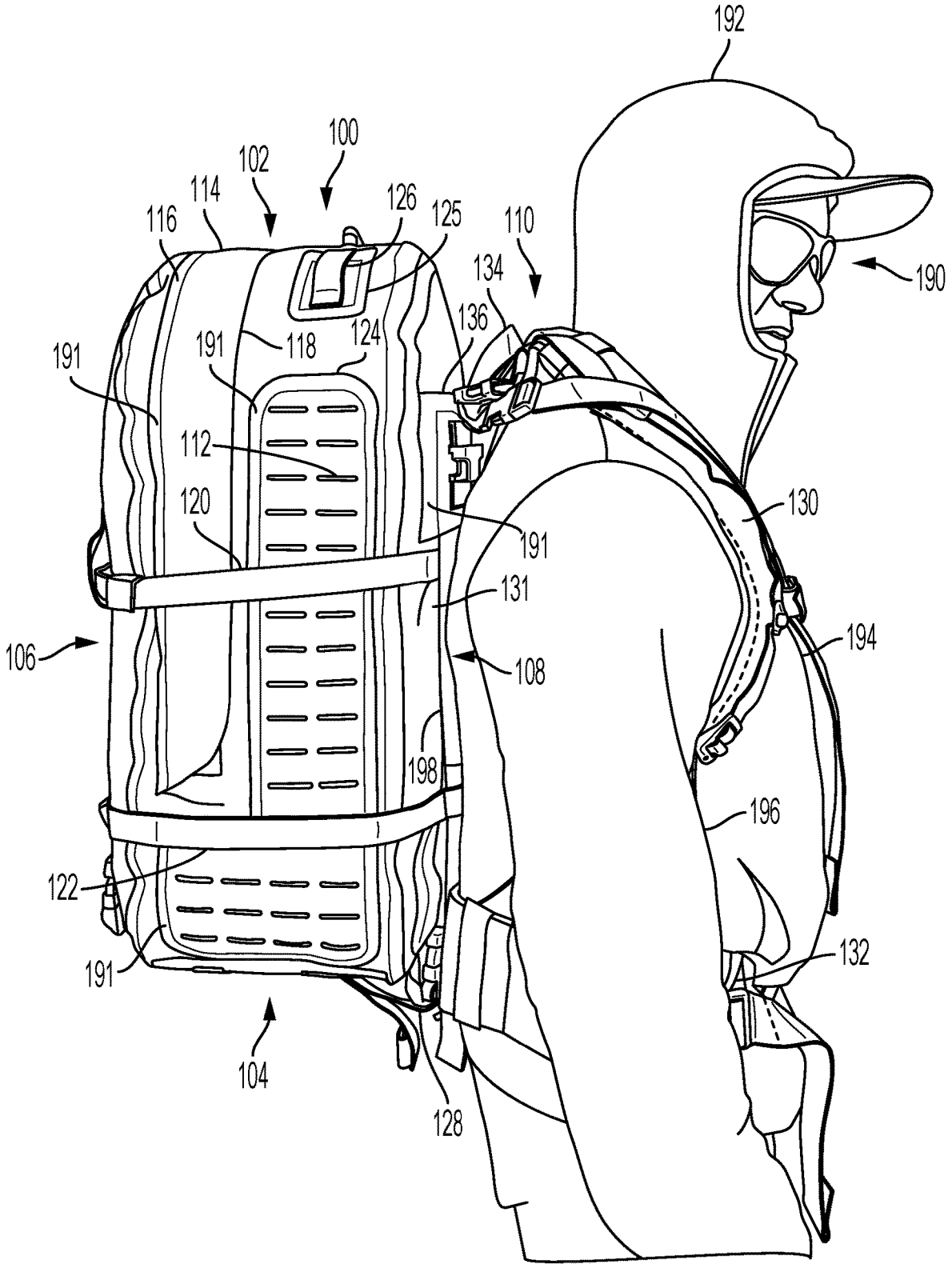
FIG. 1 shows a backpack system including a frame-less waterproof bag and a backpack frame, with the frame-less waterproof bag coupled to the backpack frame and worn at a posterior end of a wearer.
Figure 2:
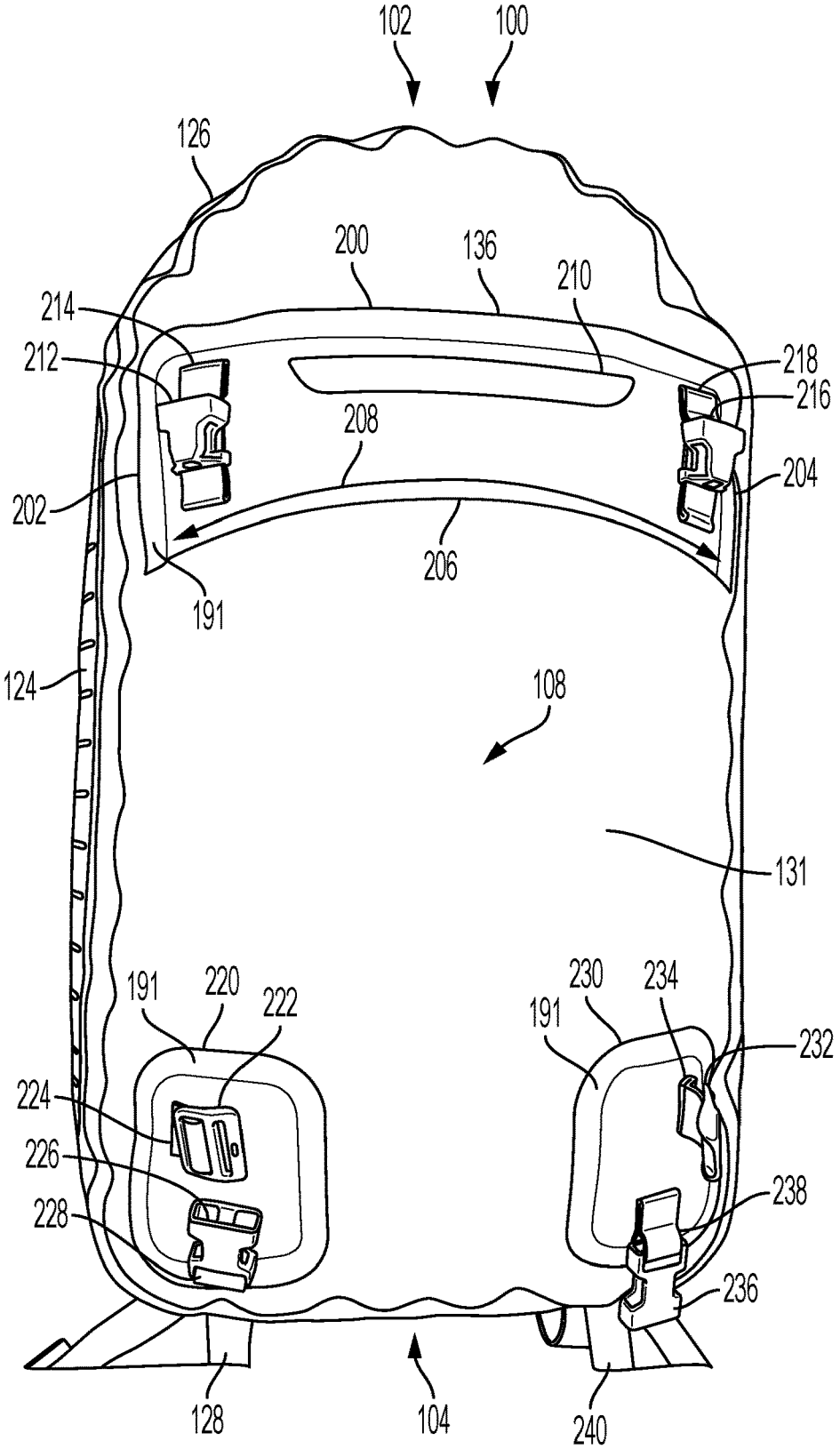
FIG. 2 shows a frame-cap mounted at a first end of the frame-less waterproof bag of the backpack system.

FIG. 1 shows a backpack system including a frame-less waterproof bag 100 and a backpack frame 110. In the example shown by FIG. 1, the frame-less waterproof bag 100 and the backpack frame 110 are coupled to each other and shown worn by a wearer 192 (e.g., a person, which may be referred to herein as a user of the backpack system). The frame-less waterproof bag 100 is supported by the backpack frame 110 and is removably coupled to the backpack frame 110 such that the frame-less waterproof bag 100 and the backpack frame 110 may be separated from each other. For example, the backpack frame 110 and frame-less waterproof bag 100 may be separated from each other for cleaning, maintenance, etc. of the frame-less waterproof bag 100 and/or backpack frame 110. The frame-less waterproof bag 100 is formed from a flexible, waterproof material, such as nylon (e.g., 500 Denier Coated CORDURA® Nylon Fabric) laminated with a thermoplastic polyurethane coating. In other examples, the flexible, waterproof material may be a different type of material, such as polyester, scrim, etc., and may be coated with a different type of coating, such as Polyvinyl Chloride (PVC).

The backpack frame 110 may be coupled to the wearer 192 via a plurality of support straps. For example, the backpack frame 110 includes a plurality of shoulder straps, such as shoulder strap 130 and shoulder strap 400 (shown by FIG. 4), and a plurality of waist straps, such as waist strap 132 and waist strap 316 (shown by FIG. 3). The shoulder straps and waist straps of the backpack frame 110 may couple around anatomical features of the wearer 192 in order to secure the backpack frame 110 to the wearer 192. Specifically, the shoulder straps may be coupled across the torso 194 of the wearer 192 (e.g., along the shoulders and the chest of the wearer 192, and around arms 196), and the waist straps may be coupled around the waist of the wearer 192 (e.g., across the stomach and/or pelvis of the wearer 192). As shown by FIG. 6, buckle 602 and counterpart buckle 604 may be coupled to waist strap 132 and waist strap 316, respectively, via a plurality of flexible bands. The buckle 602 and counterpart buckle 604 may couple together (e.g., across the stomach and/or pelvis of the wearer 192) in order to couple the waist straps around the waist of the wearer 192. In some examples, the backpack frame 110 may include a padded lumbar support 600 configured to engage with a back end 198 (e.g., posterior end) of the wearer 192 and increase a comfort of the wearer 192.

During conditions in which the frame-less waterproof bag 100 is coupled to the backpack frame 110 and the backpack frame 110 is coupled to the wearer 192 via the plurality of support straps (e.g., the shoulder straps and/or waist straps as described above), a weight of the frame-less waterproof bag 100 may be supported by the wearer 192 via the backpack frame 110 and the plurality of support straps. In one example, one or more straps of the plurality of support straps may include waterproof padding (e.g., closed-cell foam or other waterproof compressible material) in order to increase an amount of comfort of the wearer 192 during conditions in which the plurality of support straps are coupled to the wearer 192. In some examples, the padding may be embedded within one or more straps of the plurality of support straps (e.g., positioned between one or more outer layers of the straps). In other examples, the padding may be positioned at an exterior surface of the one or more straps of the plurality of support straps. In yet other examples, the one or more straps of the plurality of support straps may include padding embedded therein as well as padding positioned at exterior surfaces of the straps.

Figure 4:
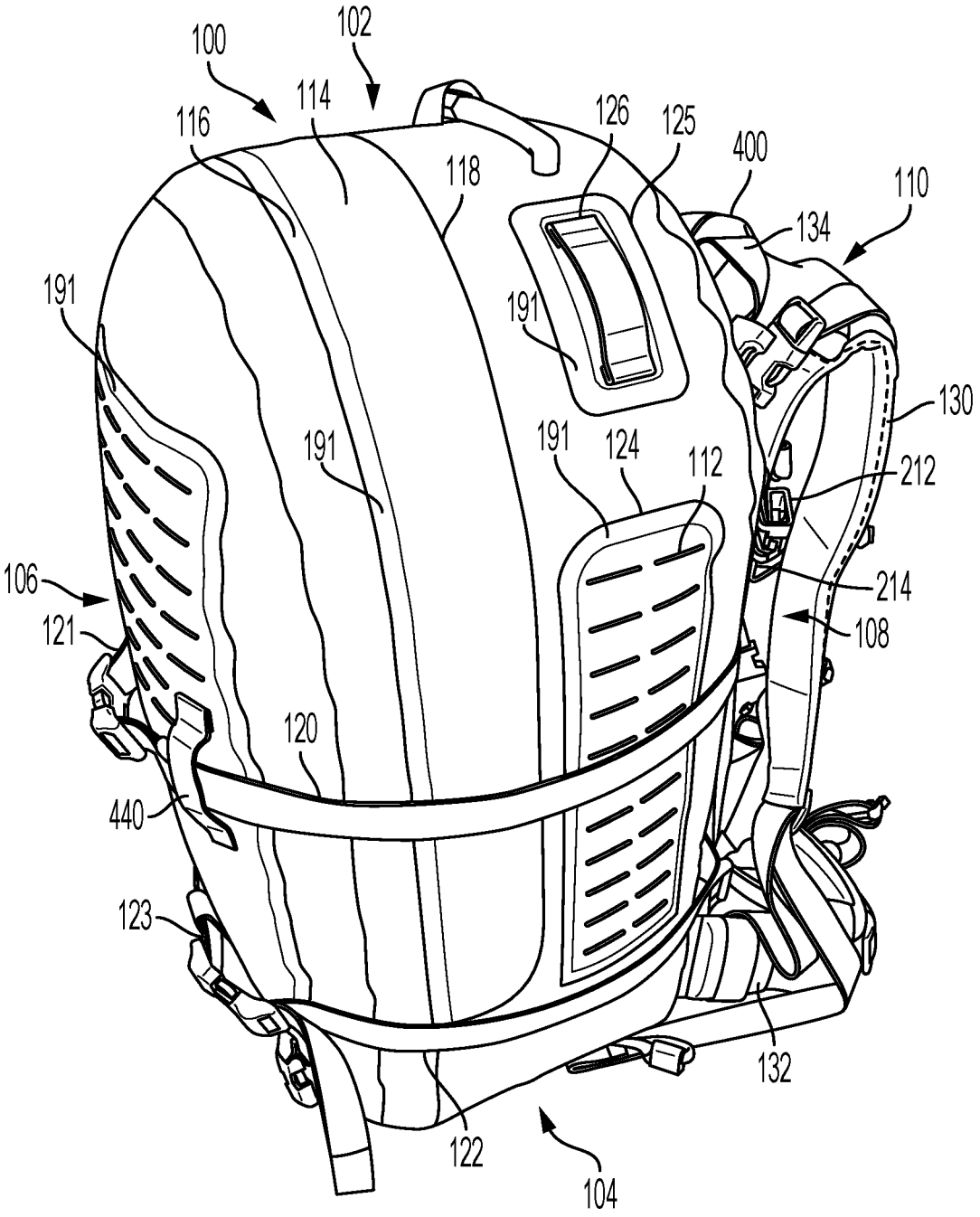
FIGS. 4-5 each show side perspective views of the backpack system, with the frame-cap coupled to the backpack frame.
Figure 5:
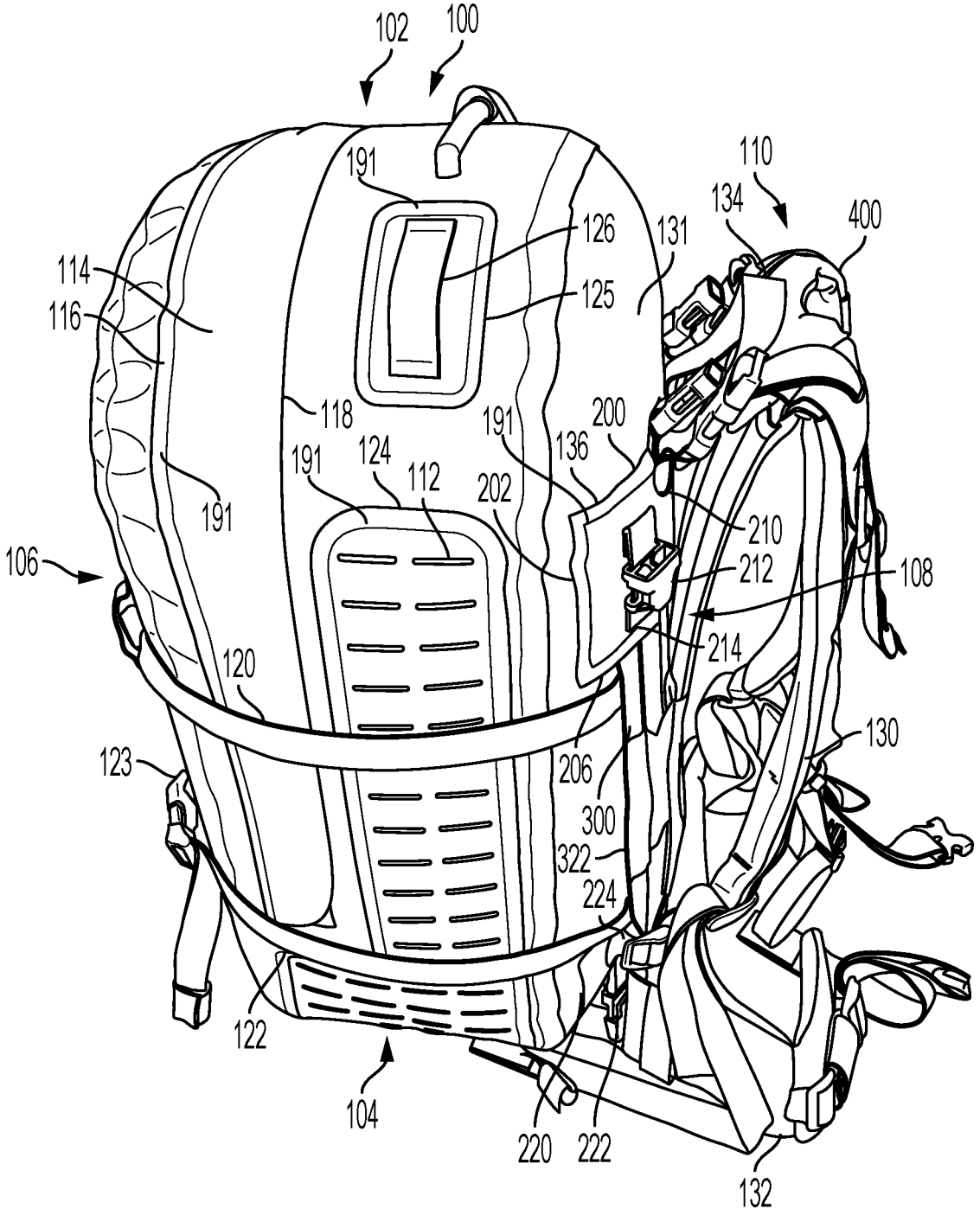

The frame-less waterproof bag 100 and the backpack frame 110 may be further coupled to each other via a plurality of flexible bands. For example, the backpack frame 110 may be further coupled to the frame-less waterproof bag 100 via band 120 and band 122. The band 120 and the band 122 may each wrap around the frame-less waterproof bag 100 in order to secure the backpack frame 110 to the frame-less waterproof bag 100 and retain a position of the backpack frame 110 relative to the frame-less waterproof bag 100. Band 120 and band 122 may each be fixedly coupled to the backpack frame 110, and may be removably coupled around the frame-less waterproof bag 100. In one example, band 120 may couple to band 121 around the frame-less waterproof bag 100 via one or more fasteners (e.g., buckles), and band 122 may couple to band 123 around the frame-less waterproof bag 100 via one or more fasteners (e.g., buckles), as shown by FIG. 4. Further examples of bands that may couple the backpack frame 110 and the frame-less waterproof bag 100 to each other are described below (e.g., band 128 and band 240 positioned at the bottom end 104 of the frame-less waterproof bag 100, etc., with band 240 being shown by FIG. 2).

In some examples, the frame-less waterproof bag 100 may include one or more reinforcement patches mounted to one or more surfaces of the frame-less waterproof bag 100. For example, FIG. 1 shows first reinforcement patch 124 mounted to a first side of the frame-less waterproof bag 100, with the first reinforcement patch 124 being positioned between a first end 106 and an opposing, second end 108 of the frame-less waterproof bag 100. Similarly, an opposing, second side of the frame-less waterproof bag 100 may include a second reinforcement patch 1002 positioned between the first end 106 and the second end 108 of the frame-less waterproof bag 100. The first end 106 is an end positioned away from the wearer 192 of the backpack system during conditions in which the frame-less waterproof bag 100 is coupled to the backpack frame 110 and the backpack frame 110 is coupled to the wearer 192. The second end 108 is configured to be positioned in face-sharing contact with the backpack frame 110 during conditions in which the frame-less waterproof bag 100 is coupled to the backpack frame 110. During conditions in which the backpack system is coupled to the wearer 192, the second end 108 is positioned at a back end 198 (e.g., posterior end) of the wearer 192.

The one or more reinforcement patches (e.g., reinforcement patch 124) may be directly mounted to the surfaces of the frame-less waterproof bag 100 in order to increase a strength of the frame-less waterproof bag 100 (e.g., a durability of the frame-less waterproof bag 100) and to provide surfaces for removably coupling modular units to the frame-less waterproof bag 100 (e.g., via slots, as described below). For example, each reinforcement patch may be formed as a separate piece, and each reinforcement patch may be welded to exterior surfaces (e.g., outer surfaces) of the frame-less waterproof bag 100 (e.g., radio frequency welded, glued, hot air welded, etc.), as indicated by welded interfaces 191. Each reinforcement patch is coupled to the exterior surfaces without producing one or more holes (e.g., openings) in the exterior surfaces of the frame-less waterproof bag 100 and without reducing the waterproof quality of the frame-less waterproof bag 100.

In some examples, the one or more reinforcement patches may include slots (e.g., slots 112 of first reinforcement patch 124 and slots 1104 of second reinforcement patch 1102). Slots 112 and/or slots 1104 may be adapted to couple one or more modular components (e.g., pouches and/or other accessories) to the frame-less waterproof bag 100. For example, the slots 124 and/or slots 1104 may be shaped, sized, arranged, etc. along the first reinforcement patch 124 and second reinforcement patch 1102 (respectively) to enable clips, straps, etc. of modular components separate from the frame-less waterproof bag 100 to be removably coupled to the frame-less waterproof bag 100. In one example, the slots 124 and/or slots 1104 may be adapted to couple with modular lightweight load-carrying equipment (MOLLE) components. In other examples, the first reinforcement patch 124 and/or the second reinforcement patch 1102 may not include the slots. In yet other embodiments, the frame-less waterproof bag 100 may not include the first reinforcement patch 124 and/or the second reinforcement patch 1102.

The frame-less waterproof bag 100 may include one or more handles in order to increase an ease of carrying the waterproof bag 100 and/or the backpack frame 110 (e.g., during conditions in which the backpack frame 110 is coupled to the frame-less waterproof bag 100). For example, handle 126 is positioned at a top end 102 of the frame-less waterproof bag 100, with the top end 102 being opposite to a bottom end 104 of the frame-less waterproof bag 100. During conditions in which the backpack system is coupled to a user (e.g., wearer 192) and the user is in an upright position (e.g., a standing position), the top end 102 is positioned closer to a head of the user (e.g., head 190 of wearer 192) and further from a ground surface on which the user stands, and the bottom end 104 is positioned closer to the ground surface on which the user stands and further from the head of the user. In other words, the top end 102 is positioned further from the ground on which the user stands than the bottom end 104 in a vertical direction (e.g., a direction of gravity).

In one example, the one or more handles may each be coupled to separate patches, and the separate patches may be directly mounted to the exterior surfaces of the frame-less waterproof bag 100. For example, handle 126 is directly coupled to patch 125, and patch 125 is directly coupled to the exterior surfaces of the frame-less waterproof bag 100 at the top end 102. In one example, the handle 126 is stitched and/or fastened to the patch 125 (e.g., via one or more fasteners extending through a thickness of the patch 125), and the patch 125 is welded (e.g., radio frequency welded, glued, hot air welded, etc.) to the exterior surfaces of the frame-less waterproof bag 100, as indicated by welded interface 191. The stitching and/or fasteners coupling the handle 126 to the patch 125 do not penetrate into the exterior surfaces of the frame-less waterproof bag 100. By welding the patch 125 to the frame-less waterproof bag 100, the patch 125 is mounted to the frame-less waterproof bag 100 without producing one or more holes (e.g., openings) in the exterior surfaces of the frame-less waterproof bag 100 and without reducing the waterproof quality of the frame-less waterproof bag 100.

A main opening of the frame-less waterproof bag 100 may be positioned toward the first end 106 of the frame-less waterproof bag 100 and may extend partially around an outer perimeter of the frame-less waterproof bag 100. An interior of the frame-less waterproof bag 100 may be sealed from an exterior of the frame-less waterproof bag 100 via one or more fasteners (e.g., waterproof zippers, such as waterproof zipper 606 shown by FIG. 6, having a pull 1000 shown by FIG. 10) coupled to the frame-less waterproof bag 100 at the main opening. The main opening may be selectively opened and/or closed (e.g., by wearer 192) in order to provide access to the interior of the frame-less waterproof bag 100 (e.g., for storage of one or more items within the interior of the frame-less waterproof bag 100).

Further, the main opening and the one or more fasteners may be covered (e.g., obscured from view) in some examples by a flap 114. The flap 114 may be formed as a separate piece from the frame-less waterproof bag 100 and may be mounted to the frame-less waterproof bag 100. For example, a first edge 116 of the flap 114 may be fixedly coupled to the frame-less waterproof bag 100 (e.g., radio frequency welded, glued, hot air welded, etc. to the frame-less waterproof bag 100, as indicated by welded interface 191), and each other edge of the flap 114 (e.g., opposing edge 118) may not be fixedly coupled to the frame-less waterproof bag 100 such that the first edge 116 is the only edge of the flap 114 fixedly coupled to the frame-less waterproof bag 100. During conditions in which the flap 114 is in a closed position (e.g., a position in which the flap 114 lays substantially flat against the exterior surfaces of the frame-less waterproof bag 100), the flap 114 may block the main opening and the one or more fasteners from view, and may increase a waterproof quality of the main opening. In order to access the main opening and the one or more fasteners, a user (e.g., wearer 192) may fold the flap 114 into an opened position, as shown by FIG. 6. The user may then unfasten the one or more fasteners (e.g., slide the waterproof zippers) in order to open the main opening and access the interior of the frame-less waterproof bag 100.

The bands adapted to couple the backpack frame 110 to the frame-less waterproof bag 100 as described above may couple around the frame-less waterproof bag 100 across the flap 114 and through a plurality of band guides. For example, as shown by FIG. 4, band 120 may couple with band 121 around the frame-less waterproof bag 100, across the flap 114, across reinforcement patches 124 and 1002 (with reinforcement patch 1002 being shown by FIG. 10), and through band guide 440.

The frame-less waterproof bag 100 is supported by the backpack frame 110 via a frame-cap 136 positioned at the second end 108 of the frame-less waterproof bag 100. The frame-cap 136 is mounted to an outer surface 131 of the frame-less waterproof bag 100 at a top portion of the second end 108 (e.g., a portion nearer to the top end 102 than the bottom end 104) and is configured to enclose a portion of the backpack frame 110 during conditions in which the backpack frame 110 is inserted into the frame-cap 136 (e.g., in order to couple the frame-less waterproof bag 100 to the backpack frame 110). In some examples, one or more handles of the backpack frame 110 (e.g., handle 134) may be inserted through a slot of the frame-cap 136 (e.g., slot 210 shown by FIG. 2) in order to increase an ease of carrying the frame-less waterproof bag 100 and backpack frame 110. The coupling of the frame-less waterproof bag 100 to the backpack frame 110 via the frame-cap 136 is described in further detail below.

FIG. 2 shows the second end 108 of the frame-less waterproof bag 100, with the frame-less waterproof bag decoupled from the backpack frame 110. Frame-cap 136 is shown positioned closer to the top end 102 of the frame-less waterproof bag 100 than the bottom end 104. The frame-cap 136 includes a first edge 200 and an opposing, second edge 206 (e.g., opposing relative to first edge 200), as well as a third edge 202 and an opposing, fourth edge 204 (e.g., opposing relative to third edge 202). The first edge 200, second edge 206, third edge 202, and fourth edge 204 may positioned in a relative arrangement such that the frame-cap 136 has an approximately rectangular shape. In other examples, the edges of the frame-cap 136 may be positioned such that the frame-cap 136 has a different type of shape (e.g., oval, triangle, etc.). As described above with reference to FIG. 1, the frame-cap 136 may include slot 210 shaped to receive one or more handles of the backpack frame 110 in order to increase an ease of carrying the frame-less waterproof bag 100 and/or the backpack frame 110 during conditions in which the frame-less waterproof bag 100 and the backpack frame 110 are coupled together.

The frame-cap 136 may be formed as a separate piece relative to the outer surface 131 of the frame-less waterproof bag 100. In one example, the frame-cap 136 may be formed of a same material as the frame-less waterproof bag 100 (e.g., a flexible waterproof fabric). The flexibility of the material forming the frame-cap 136 and the frame-less waterproof bag 100 enables the frame-less waterproof bag 100 to twist, bend, etc. (e.g., for compressing the frame-less waterproof bag 100 for transport) without reducing the waterproof quality of the frame-less waterproof bag 100. The first edge 200, third edge 202, and fourth edge 204 are each fixedly coupled to the outer surface 131 of the frame-less waterproof bag 100 at the second end 108 (e.g., radio frequency welded, glued, hot air welded, etc., as indicated by welded interface 191) and form a waterproof seal with the outer surface 131 such that water cannot flow between the first edge 200, third edge 202, fourth edge 204, and the outer surface 131. The waterproof seal is formed without stitches (e.g., via RF welding). However, the second edge 206 (e.g., the edge of the frame-cap 136 positioned closest to the bottom end 104 of the frame-less waterproof bag 100) is not fixedly coupled to the outer surface 131 and does not form a waterproof seal with the outer surface 131. The second edge 206 may be referred to herein as an open edge and is positioned closer to the bottom end 104 of the frame-less waterproof bag 100 than each of the first edge 200, third edge 202, and fourth edge 204 (which may be referred to herein as welded edges). In this configuration, the frame-cap 136 forms a pocket 1310 (shown by FIG. 13B) at the second end 108 of the frame-less waterproof bag 100, with the pocket 1310 being sealed to the frame-less waterproof bag 100 at the first edge 200, third edge 202, and fourth edge 204, and with the pocket 1310 being open at the second edge 206 (e.g., the second edge 206 forms a bottom opening of the pocket 1310).

In order to couple the frame-less waterproof bag 100 to the backpack frame 110 (as shown by FIG. 1), the backpack frame 110 may be inserted into the pocket 1310 formed by the frame-cap 136 and the outer surface 131 of the frame-less waterproof bag 100. Specifically, the backpack frame 110 may be inserted between the outer surface 131 of the frame-less waterproof bag 100 and the frame-cap 136 at the second edge 206 in order to releasably mount the frame-cap 136 to the backpack frame 110. The pocket 1310 formed by the frame-cap 136 is adapted to surround a portion of the backpack frame 110 during conditions in which the frame-cap 136 is coupled to the backpack frame 110 (e.g., the backpack frame 110 is inserted into the pocket 1310). In some examples, the second edge 206 may not be a straight edge and may instead have a curvature in a direction of the first edge 200 (e.g., curvature 208). The curvature may increase an ease with which the backpack frame 110 may be inserted into the pocket 1310 formed between the frame-cap 136 and the outer surface 131 of the frame-less waterproof bag 100.

During conditions in which the frame-less waterproof bag 100 is coupled with the backpack frame 110 and the backpack frame 110 is coupled to the wearer 192 (e.g., as shown by FIG. 1 and described above), a weight of the frame-less waterproof bag 100 may be supported by the backpack frame 110 in part due to the insertion of the backpack frame 110 into the pocket 1310 formed between the outer surface 131 of the frame-less waterproof bag 100 and the frame-cap 136. Specifically, the weight of the frame-less waterproof bag 100 may urge the frame-less waterproof bag 100 in a downward vertical direction (e.g., a direction toward the ground surface on which the wearer 192 stands). However, because the first edge 200, third edge 202, and fourth edge 204 of the frame-cap 136 are each sealed to the outer surface 131 of the frame-less waterproof bag 100, the weight of the frame-less waterproof bag 100 presses the first edge 200, third edge 202, and fourth edge 204 of the frame-cap 136 against the backpack frame 110 and retains the frame-less waterproof bag 100 in engagement with the backpack frame 110 (e.g., with the backpack frame 110 abutting the first edge 200). In this configuration, the frame-cap 136 maintains the position of the frame-less waterproof bag 100 relative to the backpack frame 110 and the wearer 192.

Additionally, because the frame-cap 136 may be formed as a separate piece that is fixedly coupled (e.g., mounted) to the frame-less waterproof bag 100, the frame-cap 136 may maintain the position of the frame-less waterproof bag 100 relative to the backpack frame 110 and the wearer 192 without reducing the waterproof quality of the frame-less waterproof bag 100. For example, the first edge 200, third edge 202, and fourth edge 204 of the frame-cap 136 may be welded (e.g., radio frequency welded, glued, hot air welded, etc., as indicated by welded interface 191) to the outer surface 131 of the frame-less waterproof bag 100 in order to fixedly couple the frame-cap 136 to the frame-less waterproof bag 100 without penetrating the outer surface 131 of the frame-less waterproof bag (e.g., without producing stitching holes or other openings through the outer surface 131).

Further, forming the frame-cap 136 as a separate piece enables other components to be coupled to the frame-cap 136 without reducing the waterproof quality of the frame-less waterproof bag 100. For example, the frame-cap 136 may include one or more flexible bands, buckles, etc. coupled to the frame-cap 136 via stitching and/or fasteners (e.g., staples) extending through a thickness of the frame-cap 136 without reducing the waterproof quality of the frame-less waterproof bag 100. In one example, the frame-cap 136 includes a first band 214 having a first buckle 212 coupled thereto and a second band 218 having a second buckle 216 coupled thereto. The first band 214 and second band 218 may each be stitched to the frame-cap 136 such that stitches coupling the bands to the frame-cap 136 penetrate through the thickness of the frame-cap 136 but do not penetrate into the outer surface 131 of the frame-less waterproof bag 100.

In this configuration, because the frame-cap 136 is fixedly coupled (e.g., radio frequency welded, glued, hot air welded, etc.) to the outer surface 131 of the frame-less waterproof bag 100 without reducing the waterproof quality of the frame-less waterproof bag 100, the first band 214 and second band 218 may be stitched to the frame-cap 136 and supported by the frame-cap 136 without reducing the waterproof quality of the frame-less waterproof bag 100 (e.g., with stitching and/or fasteners coupling the first band 214 and second band 218 to the frame-cap 136 extending through a thickness of the frame-cap 136 without penetrating the outer surface 131 and without reducing the waterproof quality of the frame-less waterproof bag 100).

The frame-less waterproof bag 100 may additionally include one or more patches fixedly coupled to the outer surface 131 of the frame-less waterproof bag 100, with the one or more patches including a plurality of buckles or other fasteners coupled thereto. For example, the frame-less waterproof bag 100 may include a first patch 220 and a second patch 230 mounted to the outer surface 131 of the frame-less waterproof bag 100 at the second end 108, closer to the bottom end 104 than the top end 102. In one example, the first patch 220 may include a band 224 and a band 228 fixedly coupled to the first patch 220 via stitching, with the band 224 and band 228 being formed of a flexible material (e.g., flexible fabric). The band 224 may be coupled to buckle 222, and the band 228 may be coupled to buckle 226. Similarly, the second patch 230 may include a band 234 and a band 238 fixedly coupled to the second patch 230 via stitching. The band 234 may be coupled to buckle 232, and the band 238 may be coupled to buckle 236.

The first patch 220 and second patch 230 may each be formed as separate pieces that are mounted to the frame-less waterproof bag 100 without reducing the waterproof quality of the frame-less waterproof bag 100. For example, each edge of the first patch 220 and second patch 230 may be welded (e.g., radio frequency welded, glued, hot air welded, etc., as indicated by welded interface 191) to the outer surface 131 of the frame-less waterproof bag 100 in order to couple the patches to the frame-less waterproof bag 100 without forming holes or other openings through the outer surface 131 (e.g., via unsealed stitching or other fasteners). The stitching coupling the band 224 and band 228 to first patch 220 and the stitching coupling the band 234 and band 238 to second patch 230 does not extend into the outer surface 131 of the frame-less waterproof bag 100. In this configuration, buckle 222, buckle 226, buckle 232, and buckle 236 may be coupled to the frame-less waterproof bag 100 (e.g., via stitching and/or fasteners extending through a thickness of the first patch 220 and the second patch 230) without reducing the waterproof quality of the frame-less waterproof bag 100.

Figure 3:
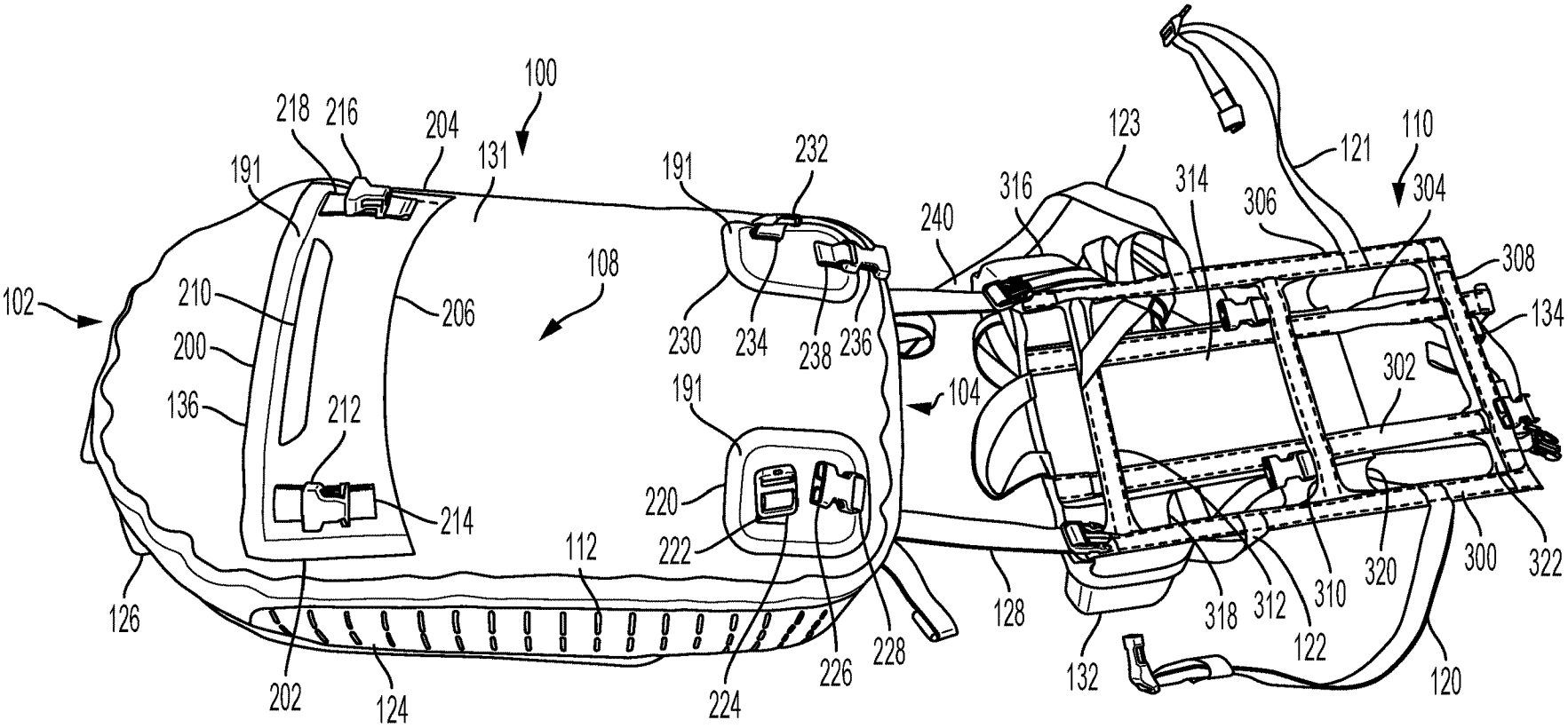
FIG. 3 shows a perspective view of the backpack system, with the frame-cap decoupled from the backpack frame.

As shown by FIG. 3 (e.g., with the frame-cap 136 of the frame-less waterproof bag 100 decoupled from the backpack frame 110), the backpack frame 110 may include a plurality of support bars and transverse bars forming a lattice configured to increase a rigidity and load-carrying quality of the backpack frame 110. For example, the backpack frame 110 may include a first support bar 300, second support bar 302, third support bar 304, and fourth support bar 306 positioned parallel to each other. Each of the first support bar 300, second support bar 302, third support bar 304, and fourth support bar 306 may be joined to a first transverse bar 308, second transverse bar 310, and third transverse bar 312, with the first transverse bar 308, second transverse bar 310, and third transverse bar 312 each being arranged perpendicular to the first support bar 300, second support bar 302, third support bar 304, and fourth support bar 306. In this configuration, the support bars and transverse bars form the lattice structure that increases a strength and durability of the backpack frame 110.

In some examples, the support bars and transverse bars described above may be formed of a composite water-resistant material such as fiberglass-reinforced carbon fiber. In other examples, the support bars and transverse bars may be formed of a non-ferrous metal, such as aluminum. In yet other examples, one or more of the support bars and/or transverse bars may be formed of a different material than each other support bar and/or transverse bar (e.g., with one or more of the support bars being formed of fiberglass-reinforced carbon fiber and with one or more of the transverse bars being formed of aluminum). Other combinations and materials are possible. By forming the support bars and transverse bars from fiberglass-reinforced carbon fiber, however, the backpack frame 110 may support an increased amount of weight (e.g., the weight of the frame-less waterproof bag 100 and its contents) while maintaining flexibility for increased comfort of the wearer 192.

In some examples, the support bars and transverse bars may be coupled together as described above via one or more fabric portions of the backpack frame 110. For example, each of the support bars and transverse bars may be enclosed by separate fabric sheathes, and one or more of the fabric sheathes may be coupled together (e.g., stitched together). As shown by FIG. 3, the backpack frame 110 may additionally include fabric reinforcement portions, such as fabric portions 318, 320, 322, and 314, to increase a durability of the backpack frame 110 and a comfort of the wearer 192. The fabric reinforcement portions may be coupled to and positioned between one or more of the support bars and/or transverse bars.

During conditions in which the backpack frame 110 is coupled with the frame-cap 136 of the frame-less waterproof bag 100 as described above, a portion of each support bar of the plurality of support bars is positioned between the frame-cap 136 and the outer surface 131. Specifically, each of the first support bar 300, second support bar 302, third support bar 304, and fourth support bar 306 is partially enclosed between the frame-cap 136 and the outer surface 131. Additionally, during conditions I which the backpack frame 110 is coupled with the frame-cap 136, an entirety of the first transverse bar 308 may be positioned between the frame-cap 136 and the outer surface 131 (e.g., abutting the first edge 200 of the frame-cap 136).

FIGS. 13A-15B show a relative positioning and coupling of the frame-cap 136 and outer surface 131 of the frame-less waterproof bag 100 during different stages of the manufacturing process of the frame-less waterproof bag 100. Specifically, FIGS. 13A-13B each show the frame-cap 136 positioned against the outer surface 131 prior to RF welding the frame-cap 136 to the outer surface 131, FIG. 14 shows the frame-cap 136 positioned against the outer surface 131 during the RF welding process, and FIGS. 15A-15B show the frame-cap 136 RF welded to the outer surface 131. Although FIGS. 13A-15B show the frame-cap 136 coupled to the outer surface 131 via RF welding, in other examples the frame-cap 136 may be coupled to the outer surface 131 via a different type of welding (e.g., hot air welding).

FIG. 13A shows a top view of the frame-cap 136 and outer surface 131, and FIG. 13B shows a cross-sectional view of the frame-cap 136 and outer surface 131 along axis 1300 shown by FIG. 13A. FIGS. 13A-13B each show a first stage of the manufacturing process, during which the frame-cap 136 and outer surface 131 are not yet welded together. As shown by FIGS. 13A-13B, prior to RF welding of the frame-cap 136 to the outer surface 131, the frame-cap 136 is positioned against the outer surface 131 (e.g., surfaces of the frame-cap 136 are positioned directly in face-sharing contact with the outer surface 131, with no other components positioned between the surfaces of the frame-cap 136 and the outer surface 131), and a die 1351 formed of an electrically conductive material (e.g., metal) is positioned against the frame-cap 136, such that the frame-cap 136 is positioned between the die 1351 and the outer surface 131. The outer surface 131 may be supported by a table or other support surface, such that the die 1351 presses the frame-cap 136 against the outer surface 131 in the direction of the table. In the example shown by FIGS. 13A-13B, the frame-cap 136 and outer surface 131 are not welded together, as indicated by un-welded interface 1350 between the frame-cap 136 and outer surface 131.

As described above, the frame-cap 136 may include first band 214 and second band 218, with the first band 214 being attached to the frame-cap 136 via stitching 1302, and with the second band 218 being attached to the frame-cap 136 via stitching 1304. The stitching 1302 and stitching 1304 do not penetrate into the outer surface 131 of the frame-less waterproof bag 100. In other examples, the first band 214 and/or second band 218 may be coupled to the frame-cap 136 in a different way (e.g., coupled via fastening hardware such as rivets, staples, etc., where the fastening hardware does not penetrate into the outer surface 131 of the frame-less waterproof bag 100).

FIG. 14 shows a cross-sectional view of the frame-cap 136 and outer surface 131 along the axis 1300 shown by FIG. 13A. FIG. 14 illustrates a second stage of the manufacturing process, during which a table press 1450 is positioned against the die 1351 in order to press the die 1351 against the frame-cap 136, and to press the frame-cap 136 against the outer surface 131. As the frame-cap 136 is pressed against the outer surface 131 by the die 1351 via the table press 1450, the die 1351 is energized (e.g., by a power source, such as an electromagnetic wave generator) and high-frequency electromagnetic energy (e.g., electromagnetic waves having a frequency of 27.120 Mhz) is produced at the interface between the frame-cap 136 and the outer surface 131. The electromagnetic energy heats the portions of the frame-cap 136 and the outer surface 131 positioned between the die 1351 and the table (e.g., un-welded interface 1350 shown by FIGS. 13A-13B) and joins to the frame-cap 136 with the outer surface 131 via welded interface 1420. The welded interface 1420 indicates a fusion of the frame-cap 136 and the outer surface 131. Said another way, the material of the frame-cap 136 and the outer surface 131 is permanently fused together at the welded interface 1420 and forms a waterproof seal at the welded interface 1420 (e.g., water is unable to flow between the frame-cap 136 and outer surface 131 at the welded interface 1420 due to the fusing of the frame-cap 136 with the outer surface 131 at the welded interface 1420). The welded interfaces 191 shown by FIGS. 1-12 may each be similar to the welded interface 1420 (e.g., each of the welded interfaces 191 may be formed via RF welding as described above with reference to welded interface 1420 and may form a waterproof seal of the frame-less waterproof bag 100).

Figure 15A:
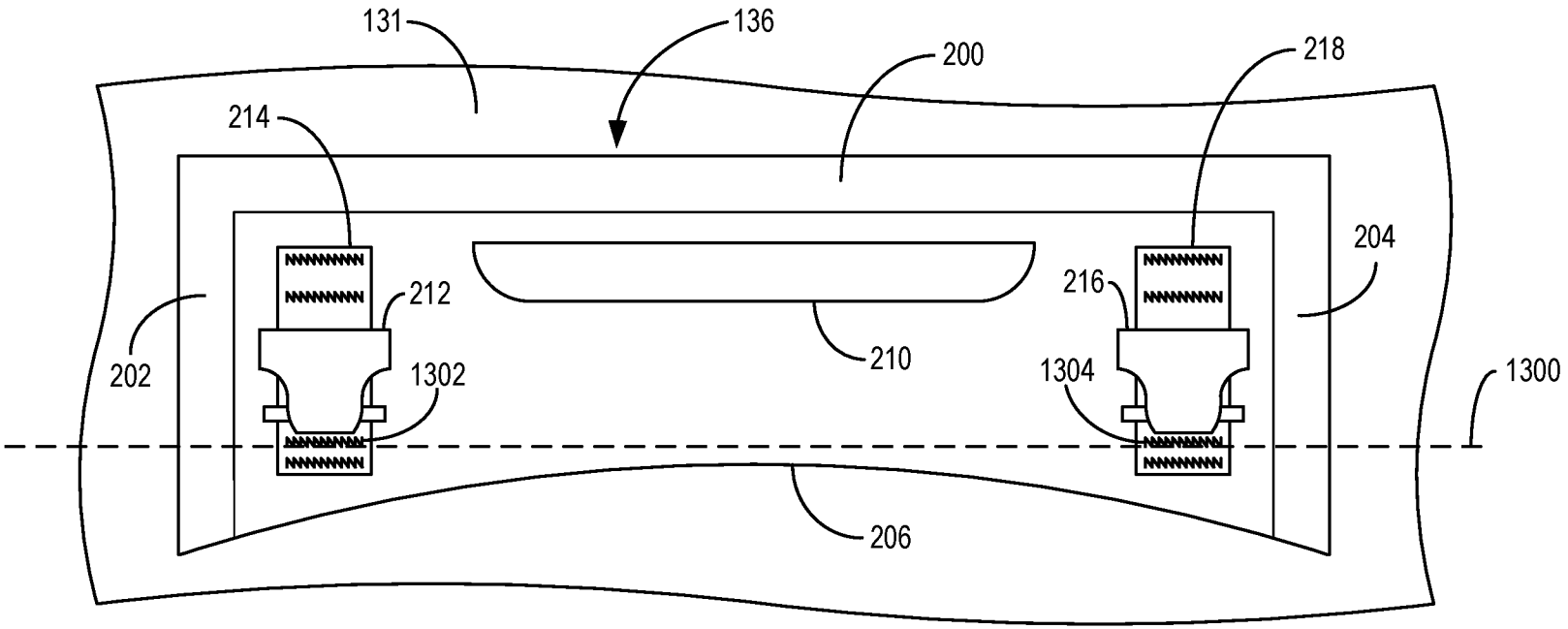
Figure 15B:
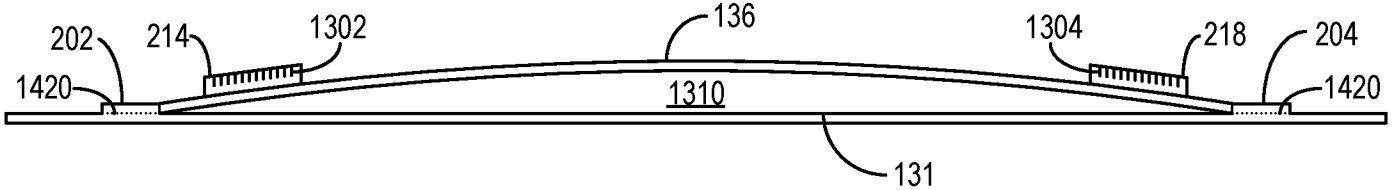

FIGS. 15A-15B each show views of the frame-cap 136 and the outer surface 131 following the second stage of the manufacturing process with the die 1351 and table press 1450 removed, with FIG. 15A showing a top view and FIG. 15B showing a cross-sectional view along the axis 1300. The welded interface 1420 indicates a waterproof coupling of the frame-cap 136 and the outer surface 131 as described above. Although FIGS. 13A-15B illustrate the coupling of the frame-cap 136 to the outer surface 131 of the frame-less waterproof bag 100, other components may be coupled to the frame-less waterproof bag 100 in a similar way. For example, first reinforcement patch 124, second reinforcement patch 1002, first patch 220, second patch 230, flap 114, and/or patch 125 may be coupled to the frame-less waterproof bag 100 via RF welding and may form corresponding waterproof seals with the outer surfaces of the frame-less waterproof bag 100, similar to the waterproof seal formed at the welded interface 1420 of the frame-cap 136 and outer surface 131 described above. In some examples, one or more of the components having a similar shape may be coupled to the frame-less waterproof bag 100 via a single die. For example, first patch 220 and second patch 230 may be RF welded to the corresponding outer surfaces of the frame-less waterproof bag 100 by first RF welding first patch 220 to the frame-less waterproof bag 100 via a die (e.g., via energization of the die, similar to die 1351) and then RF welding second patch 230 to the frame-less waterproof bag 100 via the same die (e.g., the same die used to RF weld the first patch 220 to the frame-less waterproof bag 100). In other examples, a single die may be used to simultaneously RF weld two or more components to the frame-less waterproof bag 100 (e.g., a single die positioned in contact with both of the first patch 220 and second patch 230 may be used to RF weld both of the first patch 220 and second patch 230 to the frame-less waterproof bag 100 during a single energization of the single die). In yet other examples, two or more dies may be utilized in order to simultaneously RF weld multiple components to the frame-less waterproof bag 100 (e.g., a first die may RF weld the first patch 220 to the frame-less waterproof bag 100 while a second die may RF weld the second patch 230 to the frame-less waterproof bag 100, with energization of the first die and second die occurring simultaneously). Other examples are possible.

Figure 16:
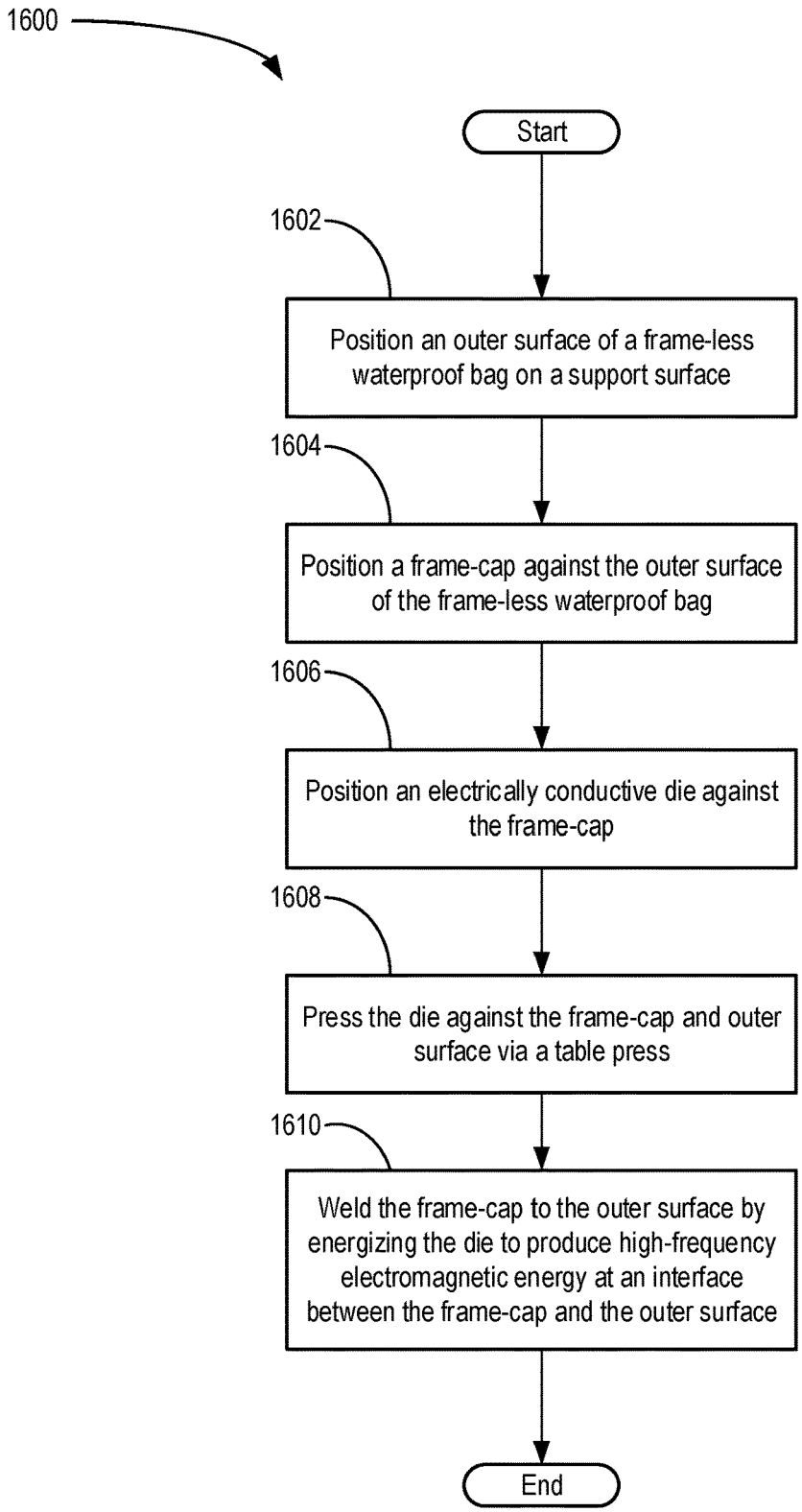
FIG. 16 illustrates a method for manufacturing a frame-less waterproof bag with a frame-cap welded thereto.

FIG. 16 illustrates a method 1600 for manufacturing a frame-less waterproof bag including a mounted frame-cap, similar to the examples described above. In some examples, the frame-less waterproof bag may be similar to frame-less waterproof bag 100 described above, and the frame-cap may be similar to frame-cap 136 described above.

At 1602, the method includes positioning an outer surface of the frame-less waterproof bag on a support surface. In one example, the outer surface may be outer surface 131 described above, and the support surface may be the table described above with reference to FIGS. 13A-15B. In some examples, the outer surface may be a sheet or portion of waterproof material used to form the frame-less waterproof bag, and the outer surface may be positioned on the support surface prior to being joined (e.g., RF welded) to a plurality of other sheets or portions of waterproof material to form the frame-less waterproof bag. For example, the outer surface at 1602 may be a sheet of waterproof material that is used to form the second end 108 of frame-less waterproof bag 100, and the outer surface may be processed according to the method 1600 prior to being RF welded to the plurality of other sheets or portions to form the frame-less waterproof bag (e.g., to form first end 106, top end 102, bottom end 104, the sides, etc.). In other examples, the outer surface may be positioned on the support surface following assembly of other portions of the frame-less waterproof bag. For example, the frame-less waterproof bag may be in a partially assembled condition (e.g., having a first end, second end, top end, bottom end, etc. welded together to form an interior and exterior of the bag), but at 1602 the bag may not include the mounted framecap. At 1602, the outer surface (e.g., outer surface 131) may be supported by the support surface, with the support surface positioned partially within the interior of the partially assembled frame-less waterproof bag.

At 1604, the method includes positioning the frame-cap against the outer surface of the frame-less waterproof bag. In one example, the frame-cap may be positioned against the outer surface of the frame-less waterproof bag as shown by FIGS. 13A-13B and described above. In particular, surfaces of the frame-cap at a first side of the frame-cap may be positioned directly in face-sharing contact with the outer surface of the frame-less waterproof bag (e.g., with no other components positioned therebetween).

At 1606, the method includes positioning an electrically conductive die against the frame-cap. In one example, the electrically conductive die may be similar to the die 1351 shown by FIGS. 13A-14 and described above. The die may have an outer perimeter similar to an outer perimeter of the frame-cap, in one example, and may be positioned at the outer perimeter of the frame-cap. Surfaces of the die may be positioned directly in face-sharing contact with surfaces of the frame-cap. Specifically, surfaces of the die may be positioned directly in face-sharing contact with surfaces of the frame-cap at a second side of the frame-cap, such that the surfaces of the frame-cap at the first side of the frame-cap are positioned directly against the outer surface of the frame-less waterproof bag and the die is positioned directly against the surfaces of the frame-cap at the second side of the frame-cap.

At 1608, the method includes pressing the die against the frame-cap and outer surface via a table press. In one example, the table press may be similar to the table press shown by FIG. 14. The table press presses the die against the frame-cap, with the frame-cap being pressed against the outer surface, and with the outer surface being supported by the support surface described above.

At 1610, the method includes welding the frame-cap to the outer surface by energizing the die to produce high-frequency electromagnetic energy at an interface between the frame-cap and the outer surface. As described above with reference to FIG. 14, the die is energized in order to heat the portions of the frame-cap and the outer surface positioned between the die and the support surface. The heated portions are fused together to form a welded interface (e.g., welded interface 1420), with the welded interface 1420 being impermeable to water (e.g., waterproof). The die may then be removed from the frame-cap and the frame-less waterproof bag may be removed from the support surface, with the frame-cap being permanently bonded to the outer surface without stitching.

Although the welding of the frame-cap to the outer surface is described above with reference to the method 1600, other components (e.g., first reinforcement patch 124, second reinforcement patch 1002, first patch 220, second patch 230, and/or patch 125, etc.) may be welded to the frame-less waterproof bag in a similar way.

FIGS. 1-15B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, the frame-less waterproof bag is configured to quickly and easily couple and/or decouple with the backpack frame via the frame-cap. By mounting the frame-cap to the frame-less waterproof bag and forming a waterproof seal between the frame-cap and the frame-less waterproof bag (e.g., by RF welding the frame-cap to the frame-less waterproof bag), the waterproof quality of the frame-less waterproof bag is not reduced. The technical effect of welding the frame-cap and other patches to the frame-less waterproof bag is to mount the frame-cap and other patches to the frame-less waterproof bag without producing perforations, openings, etc. through the surfaces of the frame-less waterproof bag and maintaining the waterproof quality of the frame-less waterproof bag.

In one embodiment, a frame-less waterproof bag comprises: an outer surface of the waterproof bag; and a frame-cap having a plurality of edges coupled to the outer surface without any penetration through the outer surface to maintain waterproof integrity of the outer surface, the frame-cap including a pocket releasably coupleable to a backpack frame. In a first example of the frame-less waterproof bag, the frame-cap is radio frequency (RF) welded to the outer surface. A second example of the frame-less waterproof bag optionally includes the first example, and further includes wherein the plurality of edges is radio frequency (RF) welded to the outer surface, the plurality of edges forming a waterproof seal with the outer surface, and wherein the frame-cap further includes an open edge that is not welded to the outer surface, the open edge forming an opening of the pocket. A third example of the frame-less waterproof bag optionally includes one or both of the first and second examples, and further includes wherein the open edge is positioned closer to a bottom end of the frame-less waterproof bag than each welded edge of the plurality of welded edges. A fourth example of the frame-less waterproof bag optionally includes one or more or each of the first through third examples, and further includes wherein the open edge has a curvature toward an opposing edge of the plurality of edges. A fifth example of the frame-less waterproof bag optionally includes one or more or each of the first through fourth examples, and further includes wherein the pocket is adapted to surround a portion of the backpack frame, the backpack frame releasably coupleable to the pocket between the open edge of the frame-cap and the outer surface of the frame-less waterproof bag. A sixth example of the frame-less waterproof bag optionally includes one or more or each of the first through fifth examples, and further includes wherein the frame-cap includes a slot shaped to receive a handle of the backpack frame.

In another embodiment, a backpack system comprises: a backpack frame; and a frame-less waterproof bag having an outer surface with a frame-cap radio frequency (RF) welded thereto, the frame-cap releasably mountable to a top portion of the backpack frame. In a first example of the backpack system, the backpack frame is adapted to releasably couple with the frame-cap between an open edge of the frame-cap and the outer surface of the frame-less waterproof bag, with the backpack frame abutting an opposing, RF welded edge of the frame-cap. A second example of the backpack system optionally includes the first example, and further includes wherein the backpack frame includes a lattice comprising a plurality of support bars joined with a plurality of perpendicular, transverse bars. A third example of the backpack system optionally includes one or both of the first and second examples, and further includes wherein a portion of each support bar of the plurality of support bars and an entirety of a transverse bar of the plurality of transverse bars is adapted to be positioned between the frame-cap and the outer surface. A fourth example of the backpack system optionally includes one or more or each of the first through third examples, and further includes wherein the frame-less waterproof bag includes an RF welded patch having a flexible band coupled thereto, the flexible band adapted to couple to the backpack frame. A fifth example of the backpack system optionally includes one or more or each of the first through fourth examples, and further includes wherein the backpack frame includes a plurality of flexible bands adapted to couple around the frame-less waterproof bag across a flap of the frame-less waterproof bag and through a plurality of band guides of the frame-less waterproof bag, the flap adapted to cover a waterproof zipper of the frame-less waterproof bag and including an RF welded edge. A sixth example of the backpack system optionally includes one or more or each of the first through fifth examples, and further includes wherein the plurality of flexible bands are adapted to couple around the frame-less waterproof bag across RF welded reinforcement patches positioned at opposing sides of the frame-less waterproof bag.

In another embodiment, an apparatus comprises: a frame-less waterproof bag having an outer surface and a top end; a frame-cap having a first edge welded to the outer surface and facing the top end, a second edge opposite the first edge and not connected to the outer surface, a third edge welded to the outer surface and extending between the first edge and the second edge, and a fourth edge welded to the outer surface and extending between the first edge and the second edge, the first edge and the second edge and the third edge and the fourth edge defining a pocket to releasably couple to a backpack frame; and a first band having a first buckle coupled thereto and a second band having a second buckle coupled thereto, the first band and the second band connected to the frame-cap via stitching and/or fasteners extending through a thickness of the frame-cap without penetrating the outer surface and without reducing the waterproof quality of the frame-less waterproof bag, the first buckle and the second buckle adapted to receive straps and/or counterpart buckles to secure the backpack frame to the frame-less waterproof bag. In a first example of the apparatus, the second edge has a curvature in a direction of the first edge, and the pocket is adapted to receive the backpack frame between the second edge and the outer surface. A second example of the apparatus optionally includes the first example, and further includes the frame-less waterproof bag includes a patch having a plurality of edges defining an entire outer perimeter of the patch, with each edge of the plurality of edges being welded to the outer surface, and with the patch including a third band connected to the patch via stitching and/or fasteners extending through a thickness of the patch without penetrating the outer surface and without reducing the waterproof quality of the frame-less waterproof bag, the third band adapted to couple to straps and/or buckles of the backpack frame to secure the backpack frame to the frame-less waterproof bag. A third example of the apparatus optionally includes one or both of the first and second examples, and further includes wherein the frame-less waterproof bag includes a reinforcement patch positioned at a side of the frame-less waterproof bag, the reinforcement patch including a plurality of edges defining an entire outer perimeter of the reinforcement patch, with each edge of the plurality of edges being welded to the outer surface, and with the reinforcement patch including a plurality of slots adapted to receive clips and/or straps. A fourth example of the apparatus optionally includes one or more or each of the first through third examples, and further includes wherein the frame-less waterproof bag includes a main opening sealed by a waterproof zipper and further includes a flap adapted to cover the main opening and waterproof zipper, the flap having a first edge welded to the outer surface and a second edge not connected to the outer surface. A fifth example of the apparatus optionally includes one or more or each of the first through fourth examples, and further includes wherein the frame-less waterproof bag includes a patch positioned at the top end and including a plurality of edges defining an entire outer perimeter of the patch, with each edge of the plurality of edges being welded to the outer surface, and with the patch including a handle connected to the patch via stitching and/or fasteners extending through a thickness of the patch without penetrating the outer surface and without reducing the waterproof quality of the frame-less waterproof bag.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An apparatus, comprising:

a frame-less waterproof bag having an outer surface and a top end;

a frame-cap having a first edge welded to the outer surface and facing the top end, a second edge opposite the first edge and not connected to the outer surface, a third edge welded to the outer surface and extending between the first edge and the second edge, and a fourth edge welded to the outer surface and extending between the first edge and the second edge, the first edge and the second edge and the third edge and the fourth edge defining a pocket adapted to receive a backpack frame to releasably couple the frame-cap to the backpack frame; and a first band having a first buckle coupled thereto and a second band having a second buckle coupled thereto, the first band and the second band connected to the frame-cap via stitching and/or fasteners extending through a thickness of the frame-cap without penetrating the outer surface and without reducing the waterproof quality of the frame-less waterproof bag, the first buckle and the second buckle adapted to receive straps and/or counterpart buckles to secure the backpack frame to the frame-less waterproof bag.

2. The apparatus of claim 1, wherein the second edge has a curvature in a direction of the first edge, and wherein the pocket is adapted to receive the backpack frame between the second edge and the outer surface.

3. The apparatus of claim 1, wherein the frame-less waterproof bag includes a patch having a plurality of edges defining an entire outer perimeter of the patch, with each edge of the plurality of edges being welded to the outer surface, and with the patch including a third band connected to the patch via stitching and/or fasteners extending through a thickness of the patch without penetrating the outer surface and without reducing the waterproof quality of the frame-less waterproof bag, the third band adapted to couple to straps and/or buckles of the backpack frame to secure the backpack frame to the frame-less waterproof bag.

4. The apparatus of claim 1, wherein the frame-less waterproof bag includes a reinforcement patch positioned at a side of the frame-less waterproof bag, the reinforcement patch including a plurality of edges defining an entire outer perimeter of the reinforcement patch, with each edge of the plurality of edges being welded to the outer surface, and with the reinforcement patch including a plurality of slots adapted to receive clips and/or straps.

5. The apparatus of claim 1, wherein the frame-less waterproof bag includes a main opening sealed by a waterproof zipper and further includes a flap adapted to cover the main opening and waterproof zipper, the flap having a first edge welded to the outer surface and a second edge not connected to the outer surface.

6. The apparatus of claim 1, wherein the frame-less waterproof bag includes a patch positioned at the top end and including a plurality of edges defining an entire outer perimeter of the patch, with each edge of the plurality of edges being welded to the outer surface, and with the patch including a handle connected to the patch via stitching and/or fasteners extending through a thickness of the patch without penetrating the outer surface and without reducing the waterproof quality of the frame-less waterproof bag.

* * * * *